US008555525B2

(12) United States Patent
Mahoney

(10) Patent No.: US 8,555,525 B2
(45) Date of Patent: Oct. 15, 2013

(54) FOOTWEAR

(75) Inventor: Christopher J. Mahoney, Concord, MA (US)

(73) Assignee: Saucony IP Holdings LLC, Rockford, MI (US)

( * ) Notice: Subject to any disclaimer, the term of this patent is extended or adjusted under 35 U.S.C. 154(b) by 470 days.

(21) Appl. No.: 13/008,659

(22) Filed: Jan. 18, 2011

(65) Prior Publication Data

US 2012/0180335 A1 Jul. 19, 2012

(51) Int. Cl.
*A43B 7/06* (2006.01)

(52) U.S. Cl.
USPC ..... 36/25 R; 369/29; 369/3 R; 369/3 A

(58) Field of Classification Search
USPC ..... 36/25 R, 28, 29, 45, 3 R, 3 A, 3 B
See application file for complete search history.

(56) References Cited

U.S. PATENT DOCUMENTS

| | | | | |
|---|---|---|---|---|
| 290,460 | A | 12/1883 | Mitchell | |
| 955,337 | A | 4/1910 | Lawlor | |
| 1,949,318 | A | 2/1934 | Markowsky | |
| 2,298,941 | A | 10/1942 | Herrmann | |
| 2,311,996 | A | 2/1943 | Parker | |
| 2,622,052 | A * | 12/1952 | Chandler | 36/45 |
| 3,040,454 | A | 6/1962 | Lopper et al. | |
| 3,087,262 | A * | 4/1963 | Russell | 36/28 |
| 3,535,800 | A | 10/1970 | Stöhr | |
| 3,821,858 | A | 7/1974 | Haselden | |
| 4,041,618 | A * | 8/1977 | Famolare, Jr. | 36/25 R |
| 4,133,118 | A * | 1/1979 | Khalsa et al. | 36/83 |
| 4,223,456 | A * | 9/1980 | Cohen | 36/29 |
| 4,447,967 | A | 5/1984 | Zaino et al. | |
| 4,534,122 | A | 8/1985 | MacPhail | |
| 4,562,652 | A | 1/1986 | Hensler | |
| 4,677,769 | A | 7/1987 | Ahmad et al. | |
| 4,769,928 | A | 9/1988 | Ward | |
| 4,839,972 | A | 6/1989 | Pack et al. | |
| 4,858,339 | A | 8/1989 | Hayafuchi et al. | |
| 4,920,666 | A | 5/1990 | Marega | |
| 4,989,350 | A | 2/1991 | Bunch et al. | |
| 5,243,772 | A | 9/1993 | Francis et al. | |
| 5,711,092 | A | 1/1998 | Despres et al. | |
| 5,752,331 | A | 5/1998 | Perrissoud et al. | |
| 5,884,420 | A | 3/1999 | Donnadieu | |
| 5,946,824 | A * | 9/1999 | Tighe et al. | 36/28 |

(Continued)

FOREIGN PATENT DOCUMENTS

| | | | |
|---|---|---|---|
| DE | 3415960 | A1 | 11/1984 |
| DE | 4018518 | A1 | 1/1991 |

(Continued)

*Primary Examiner* — Marie Patterson
(74) *Attorney, Agent, or Firm* — Warner Norcross & Judd LLP

(57) ABSTRACT

A footwear article includes an upper assembly attached to a sole. The upper assembly includes an enclosure defining a foot receiving void and a flex feature disposed on a medial portion of the upper assembly. The flex feature connects a medial forefoot portion of the enclosure to a medial heel portion of the enclosure, thus allowing the medial forefoot and medial heel portions of the enclosure to move relative to each other. The sole assembly includes a midsole disposed on an outsole. The midsole defines voids of different depths. The voids are arranged to provide relatively greater cushioning and bendability within at least one of a metatarsus portion and a calcaneus portion of the midsole.

54 Claims, 21 Drawing Sheets

(56) References Cited

U.S. PATENT DOCUMENTS

| | | | | |
|---|---|---|---|---|
| 5,956,868 | A | 9/1999 | Stevens et al. | |
| 5,996,251 | A | 12/1999 | LaDuca | |
| 6,076,286 | A | 6/2000 | Donnadieu | |
| 6,266,896 | B1 * | 7/2001 | Liu | 36/28 |
| 6,305,103 | B1 | 10/2001 | Camargo | |
| 6,374,515 | B1 | 4/2002 | Davis | |
| 6,745,498 | B2 | 6/2004 | LaDuca | |
| 6,817,116 | B2 | 11/2004 | Chil et al. | |
| 7,051,458 | B2 | 5/2006 | LaDuca | |
| 7,140,129 | B2 * | 11/2006 | Newson et al. | 36/100 |
| 7,475,497 | B2 * | 1/2009 | Hoffer et al. | 36/28 |
| 7,690,132 | B2 | 4/2010 | Wilkenfeld | |
| 7,730,634 | B2 | 6/2010 | LaDuca | |
| 7,823,298 | B2 | 11/2010 | Nishiwaki et al. | |
| 2002/0078591 | A1 | 6/2002 | Morrone | |
| 2005/0016023 | A1 * | 1/2005 | Burris et al. | 36/45 |
| 2005/0108898 | A1 | 5/2005 | Jeppesen et al. | |
| 2005/0188562 | A1 * | 9/2005 | Clarke et al. | 36/15 |
| 2006/0156579 | A1 | 7/2006 | Hoffer et al. | |
| 2006/0277793 | A1 | 12/2006 | Hardy et al. | |
| 2007/0107264 | A1 | 5/2007 | Meschter et al. | |
| 2007/0107265 | A1 | 5/2007 | Mueller et al. | |
| 2007/0151121 | A1 * | 7/2007 | Touzov | 36/3 R |
| 2007/0169379 | A1 * | 7/2007 | Hazenberg et al. | 36/102 |
| 2010/0083535 | A1 | 4/2010 | Meschter et al. | |

FOREIGN PATENT DOCUMENTS

| | | | |
|---|---|---|---|
| EP | 0047710 | A1 | 3/1982 |
| EP | 0234908 | A2 | 9/1987 |
| EP | 0375306 | | 6/1990 |
| EP | 0562697 | A1 | 9/1993 |
| JP | 59108405 | A | 6/1984 |
| JP | 60018082 | A | 1/1985 |
| JP | 01026245 | A | 1/1989 |
| JP | 01139710 | A | 6/1989 |
| JP | 02116807 | A | 5/1990 |
| JP | 03010154 | A | 1/1991 |
| JP | 03025914 | A | 2/1991 |
| JP | 33-5240 | | 4/1991 |
| JP | 4107608 | A | 4/1992 |
| JP | 06019157 | A | 1/1994 |
| JP | 07011966 | A | 1/1995 |
| JP | 08317806 | A | 12/1996 |
| JP | 11000636 | A | 1/1999 |
| JP | 11018803 | A | 1/1999 |
| JP | 2000184902 | A | 7/2000 |
| JP | 2000287704 | A | 10/2000 |
| JP | 2002209608 | A | 7/2002 |
| JP | 2002345506 | A | 12/2002 |
| WO | WO-0074514 | A1 | 12/2000 |
| WO | WO-2007059017 | A1 | 5/2007 |

* cited by examiner

FOOTWEAR

TECHNICAL FIELD

This disclosure relates to footwear.

BACKGROUND

Articles of footwear, such as shoes, are generally worn while exercising to protect and provide stability of a user's feet. In general, shoes include an upper portion and a sole. When the upper portion is secured to the sole, the upper portion and the sole together define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe. The sole generally provides support for a user's foot and acts as an interface between the user's foot and the ground.

SUMMARY

One aspect of the disclosure provides a midsole for an article of footwear. The midsole includes a midsole body defining voids of different depths. The voids are arranged to provide relatively greater cushioning and bendability within at least one of a metatarsus portion and a calcaneus portion of the midsole body.

Implementations of the disclosure may include one or more of the following features. In some implementations, the voids are arranged in a two-dimensional area. The voids may envelop at least 50% of a surface area of a top surface of the midsole body. The voids may define at least one of a square, polygonal, and circular cross-sectional shape. Other cross-sectional shapes are possible as well. In some examples, the voids defined in the metatarsus portion of the midsole body have at least one of a larger cross-sectional area and a deeper depth than voids defined in a heel portion of the midsole body. Moreover, voids defined in the metatarsus portion of the midsole body may have at least one of a larger cross-sectional area and a deeper depth than voids defined in a phalanges portion of the midsole body. Voids defined in the metatarsus portion of the midsole body may have at least one of a larger cross-sectional area and a deeper depth than voids defined in at least one of a phalanges portion, an arch portion, and the calcaneus portion of the midsole body.

In some implementations, voids defined in the calcaneus portion have at least one of a larger cross-sectional area and a deeper depth than voids defined in the metatarsus portion of the midsole body. Voids defined in the metatarsus and calcaneus portions of the midsole body may have at least one of a larger cross-sectional area and a deeper depth than any remaining voids defined by the midsole body. Voids defined near a periphery of the midsole body may, in some examples, have at least one of a smaller cross-sectional area and a shallower depth than any remaining voids defined by the midsole body.

For some midsoles, the voids defined in the metatarsus and calcaneus portions of the midsole body have a cross-sectional area of between about 4 $mm^2$ and about 100 $mm^2$ and voids defined in a phalanges portion and an arch portion of the midsole body have a cross-sectional area of between about 4 $mm^2$ and about 25 $mm^2$. In the same or other midsoles, voids defined in the metatarsus and calcaneus portion of the midsole body have a depth of between about 4 mm and about 10 mm and voids defined in a phalanges portion and an arch portion of the midsole body have a depth of between about 1 mm and about 5 mm. Voids defined in the metatarsus and calcaneus portions of the midsole body may have a depth of between about 45% and 90% a thickness of the midsole body.

In some examples, the midsole body defines a two-dimensional array of voids each having a substantially square cross-sectional shaped in a top surface of the midsole body. The array has first and second perpendicular axes, both arranged to form an angle of about 45° with respect to a transverse axis of the midsole. Voids defined in the metatarsus portion may have a relatively deeper depth than voids defined by other portions of the midsole body.

Another aspect of the disclosure provides an upper for an article of footwear. The upper includes a mesh enclosure having an inner layer connected to an outer layer by linking filaments. The outer layer defines apertures such that apertures defined in a forefoot portion of the upper have a size relatively larger size than apertures defined in a heel portion of the upper. A flex feature disposed on a medial portion of the upper and connects a medial forefoot portion of the enclosure to a medial heel portion of the enclosure. The flex feature allows the medial forefoot and medial heel portions of the enclosure to move relative to each other.

In some implementations, apertures defined by the outer enclosure layer in the forefoot portion of the upper have a diameter at least 25% larger than a diameter of apertures defined by the outer enclosure layer in the heel portion of the upper. The apertures defined by the outer enclosure layer may gradually transition in size between the forefoot and heel portions of the upper. Moreover, the apertures may envelop at least 45% of the outer enclosure layer. In some examples, the mesh enclosure has a relatively tighter construction in the heel portion than the forefoot portion of the upper. The construction of the mesh enclosure may gradually transition in tightness between the forefoot and heel portions of the upper.

The flex feature may extend from a bottom sole edge of the upper to a lacing region of the upper. In some examples, a longitudinal axis of the flex feature is arranged at an angle of between about 30° and about 90° with respect to a ground contact surface of a sole attached to the upper. The flex feature may define an arcuate shape and/or comprise a stretchable material, such as a stretchable synthetic textile. The flex feature may have a width in a direction along the surface of the enclosure of between about 2 mm and about 2 cm.

Lateral and medial portions of the enclosure may define corresponding lateral and medial clefts that extend from a tongue opening defined by the enclosure. The clefts separate forward and heel portions of a lacing region of the upper, thus allowing the forward and heel portions of the lacing region of the upper to move with respect to each other. In some examples, the medial cleft extends from the tongue opening to a sole attached to the upper, separating the medial forefoot and medial heel portions of the enclosure. The flex feature connects the separated medial forefoot and medial heel portions of the enclosure. The flex feature may terminate outside of the lacing region of the upper.

The upper may include a molded foam insert disposed about a foot opening defined by the enclosure. The molded foam insert defines embossed features arranged to anatomically fit a received foot.

In yet another aspect, a footwear article includes an upper assembly attached to a sole assembly (e.g., by adhesives, stitching, a combination thereof, etc.). The upper assembly includes an enclosure defining a foot receiving void and a flex feature disposed on a medial portion of the upper assembly. The flex feature connects a medial forefoot portion of the enclosure to a medial heel portion of the enclosure, thus allowing the medial forefoot and medial heel portions of the enclosure to move relative to each other. The sole assembly includes a midsole disposed on an outsole. The midsole defines voids of different depths. The voids are arranged to provide relatively greater cushioning and bendability within at least one of a metatarsus portion and a calcaneus portion of the midsole.

Implementations of the disclosure may include one or more of the following features. In some implementations, the enclosure comprises a mesh having an inner layer connected to an outer layer by linking filaments. The outer layer defines apertures such that apertures defined in a forefoot portion of the upper assembly have a size relatively larger size than apertures defined in a heel portion of the upper assembly. Apertures defined by the outer enclosure layer in the forefoot portion of the upper may have a diameter at least 25% larger than a diameter of apertures defined by the outer enclosure layer in the heel portion of the upper assembly. The apertures defined by the outer enclosure layer may gradually transition in size between the forefoot and heel portions of the upper assembly. In some examples, the apertures envelop at least 45% of the outer enclosure layer. The enclosure may comprise a mesh material having a relatively tighter construction in a heel portion of the upper assembly than a forefoot portion of the upper assembly. Moreover, the construction of the mesh enclosure may gradually transitions in tightness between the forefoot and heel portions of the upper assembly.

In some implementations, the flex feature extends from the sole assembly to a lacing region of the upper assembly. A longitudinal axis of the flex feature can be arranged at an angle of between about 30° and about 90° with respect to a ground contact surface of the sole assembly. The flex feature may define an arcuate shape. Moreover, the flex feature may comprises a stretchable material. In some examples, the flex feature has a width in a direction along the surface of the enclosure of between about 2 mm and about 2 cm.

Lateral and medial portions of the enclosure may define corresponding lateral and medial clefts extending from a tongue opening defined by the enclosure. The clefts separate forward and heel portions of a lacing region of the upper, thus allowing the forward and heel portions of the lacing region of the upper to move with respect to each other. In some examples, the medial cleft extends from the tongue opening to the sole assembly, separating the medial forefoot and medial heel portions of the enclosure. The flex feature connects the separated medial forefoot and medial heel portions of the enclosure. The flex feature may terminate outside of the lacing region of the upper.

The footwear article may include a molded foam insert disposed about a foot opening defined by the enclosure. The molded foam insert defines embossed features arranged to anatomically fit a received foot.

In some implementations, the voids are arranged in a two-dimensional area. The voids may envelop at least 50% of a surface area of a top surface of the midsole. Voids defined in the metatarsus portion of the midsole may have at least one of a larger cross-sectional area and a deeper depth than voids defined in a heel portion of the midsole. Moreover, voids defined in the metatarsus portion of the midsole may have at least one of a larger cross-sectional area and a deeper depth than voids defined in a phalanges portion of the midsole. Voids defined in the metatarsus portion of the midsole may have at least one of a larger cross-sectional area and a deeper depth than voids defined in at least one of a phalanges portion, an arch portion, and the calcaneus portion of the midsole.

Voids defined in the calcaneus portion of the midsole, in some examples, have at least one of a larger cross-sectional area and a deeper depth than voids defined in the metatarsus portion of the midsole. Voids defined in the metatarsus and calcaneus portions of the midsole may have at least one of a larger cross-sectional area and a deeper depth than any remaining voids defined by the midsole. Moreover, voids defined near a periphery of the midsole may have at least one of a smaller cross-sectional area and a shallower depth than any remaining voids defined by the midsole.

In some footwear articles, voids defined in the metatarsus and calcaneus portions of the midsole have a cross-sectional area of between about 4 $mm^2$ and about 100 $mm^2$ and voids defined in a phalanges portion and an arch portion of the midsole have a cross-sectional area of between about 4 $mm^2$ and about 25 $mm^2$. In the same or other footwear articles, voids defined in the metatarsus and calcaneus portion of the midsole have a depth of between about 4 mm and about 10 mm and voids defined in a phalanges portion and an arch portion of the midsole have a depth of between about 1 mm and about 5 mm. Voids defined in the metatarsus and calcaneus portions of the midsole may have a depth of between about 45% and 90% a thickness of the midsole.

In some implementations, the midsole defines a two-dimensional array of voids each having a substantially square cross-sectional shape in a top surface of the midsole. The array has first and second perpendicular axes, both arranged to form an angle of about 45° with respect to a transverse axis of the midsole. Voids defined in the metatarsus portion have a relatively deeper depth than voids defined by other portions of the midsole.

The details of one or more implementations of the disclosure are set forth in the accompanying drawings and the description below. Other aspects, features, and advantages will be apparent from the description and drawings, and from the claims.

Figures 1A, 1B:
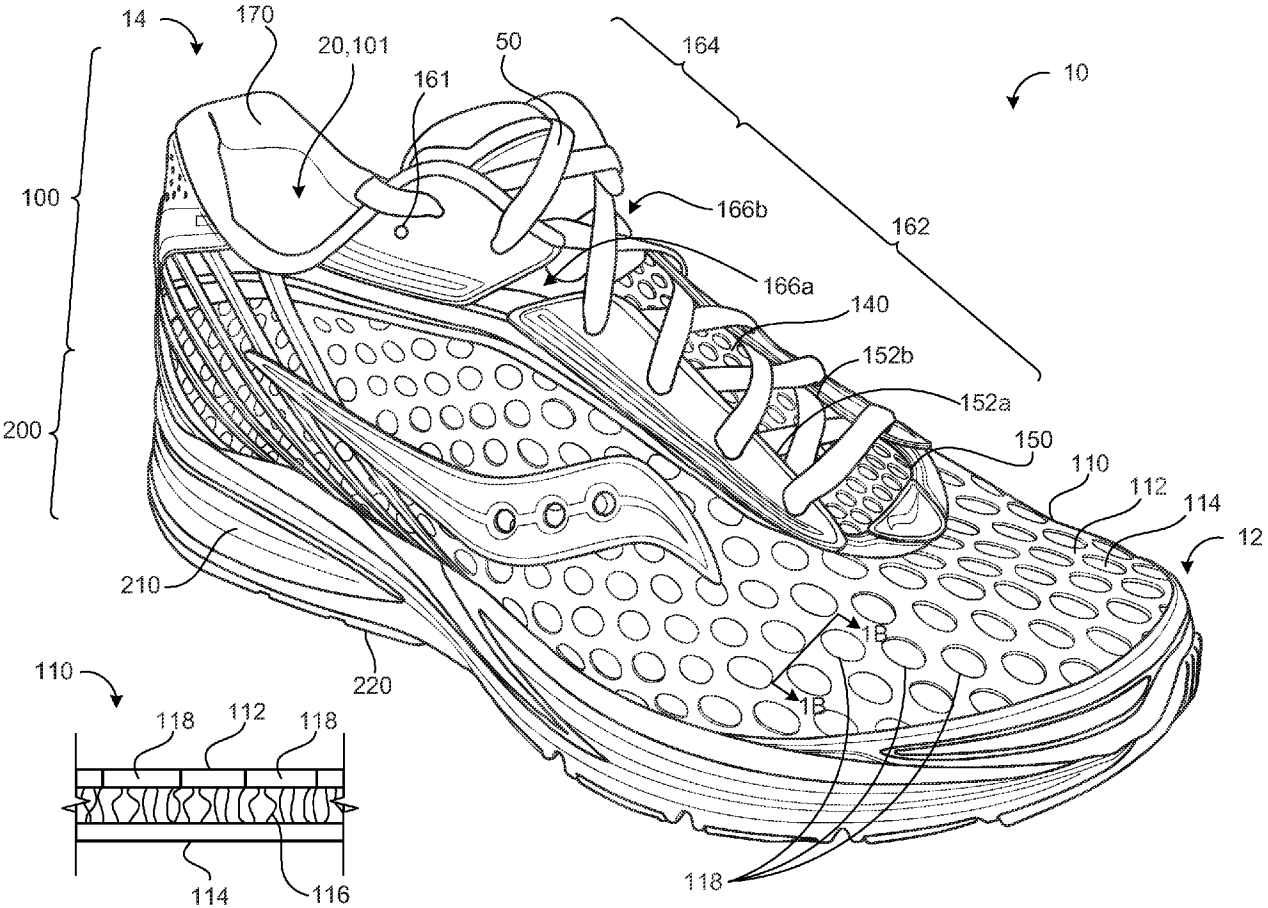
FIG. 1A is a perspective view of an exemplary article of footwear.
FIG. 1B is a section view of the upper assembly of the article of footwear shown in FIG. 1A along line 1B-1B.
Figure 2:
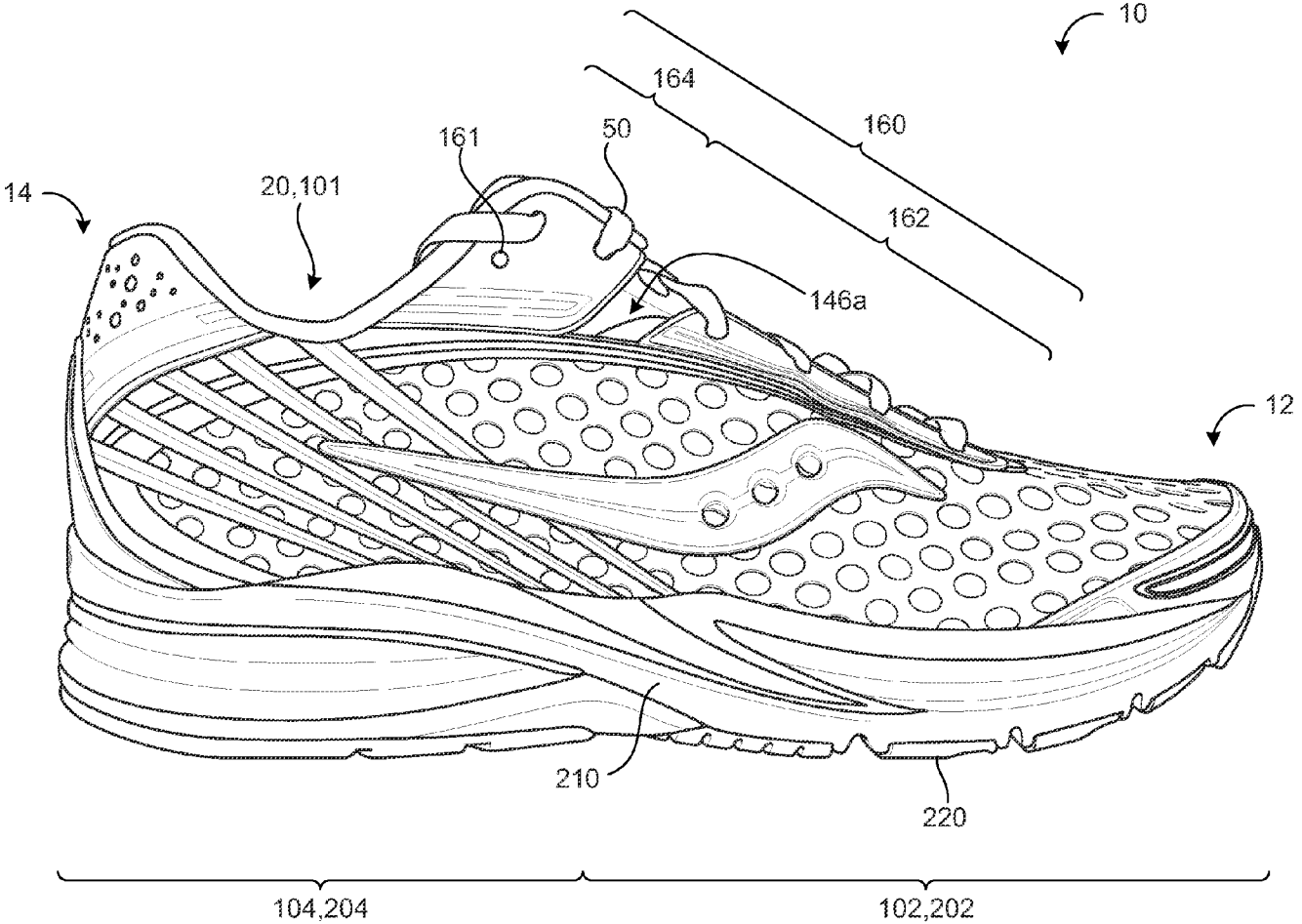
FIG. 2 is a lateral side view of the article of footwear shown in FIG. 1.

Like reference symbols in the various drawings indicate like elements. By way of example only, all of the drawings are directed to an article of footwear suitable to be worn on a right foot. The invention also includes the mirror images of the drawings, i.e. an article of footwear suitable to be worn on a left foot.

DETAILED DESCRIPTION

Referring to FIGS. 1A-7, in some implementations, an article of footwear 10 includes an upper assembly 100 attached to a sole assembly 200 (e.g., by stitching and/or an adhesive). Together, the upper assembly 100 and the sole assembly 200 define a foot void 20 configured to securely and comfortably hold a human foot. The upper assembly 100 defines a foot opening 101 for receiving a human foot into the foot void 20. The upper assembly 100 and the sole assembly 200 each have a corresponding forefoot portion 102, 202 and a corresponding heel portion 104, 204. Moreover, the upper assembly 100 and the sole assembly 200 each have a corresponding lateral portion 106, 207 and a corresponding medial portion 108, 208. Although the examples shown illustrates a shoe, the article of footwear 10 may be configured as other types of footwear, including, but not limited to boots, sandals, flip-flops, clogs, etc.

Referring to FIGS. 1A and 1B, the upper assembly 100 includes an enclosure layer 110 that may extend from a toe end 12 of the shoe 10 to a heel end 14 of the shoe 10. The enclosure layer 110 may comprise a mesh material (e.g., two-way, four-way, or three-dimensional mesh). Moreover, in some examples, the enclosure layer 110 comprises a variable thickness knit or weave that provides relatively greater breathability in the forefoot portion 102 of the upper assembly 100 as compared to heel portion 104 of the upper assembly 100. In the examples shown, the enclosure layer 110 has a relatively more open mesh for breathability in the forefoot portion 102 of the upper assembly 100 as compared to heel portion 104 of the upper assembly 100. For example, the enclosure layer 110 may comprise a three dimensional mesh material having an inner layer 112, an outer layer 114, and fibers, threads, or filaments 116 extending therebetween in an arrangement that allows air and moisture to pass between the inner and outer layers 112, 114. The filaments 116 may be a loose configuration of fibers in a random or ordered arrangement. Moreover, the inner and outer layers 112, 114 can be offset for each other by a fixed or variable distance limited by the filaments 116 attached between the two layers 112, 114.

One of the inner and outer layers 112, 114 may define apertures 118 (e.g., circular having a diameter of between about 5 mm and about 20 mm) to provide additional breathability through the enclosure layer 110. The apertures 118 may envelop at least 45% of the outer enclosure layer 114. The outer enclosure layer 114 in the forefoot portion 102 may have relatively larger apertures 118 than apertures 118 defined in the heel portion 104 to provide additional breathability in the forefoot portion 102, while providing a relatively stronger material in heel portion 104 for support and closure. Moreover, a construction (e.g., knit or weave) of the enclosure layer 110 may be relatively looser in the forefoot upper assembly portion 102 than the heel upper assembly portion 104. A relatively tighter construction of the enclosure layer 110 in the heel portion 104 can provide support and stability for a heel portion of a received foot.

Figure 3:
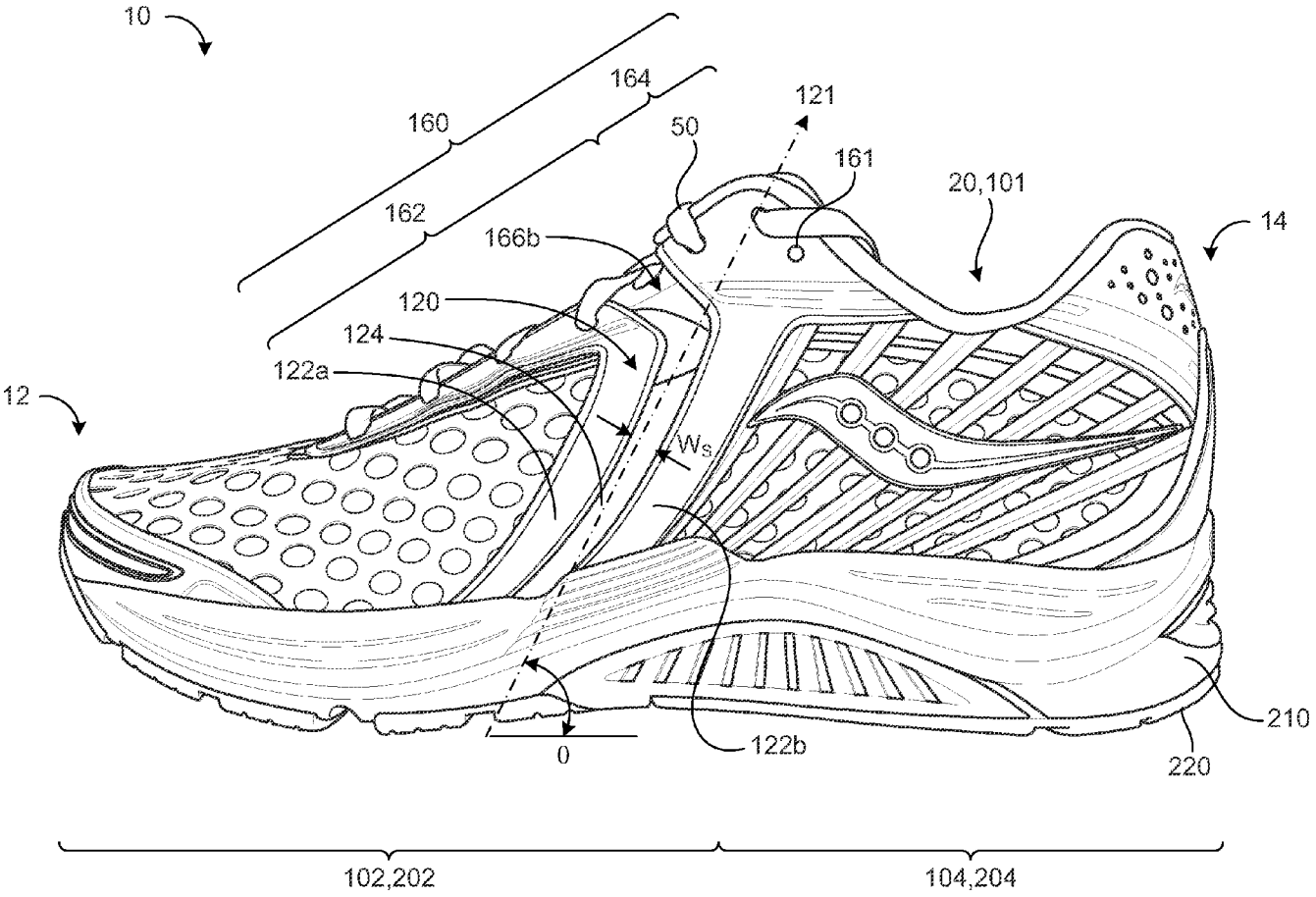
FIG. 3 is a medial side view of the article of footwear shown in FIG. 1.
Figure 4:
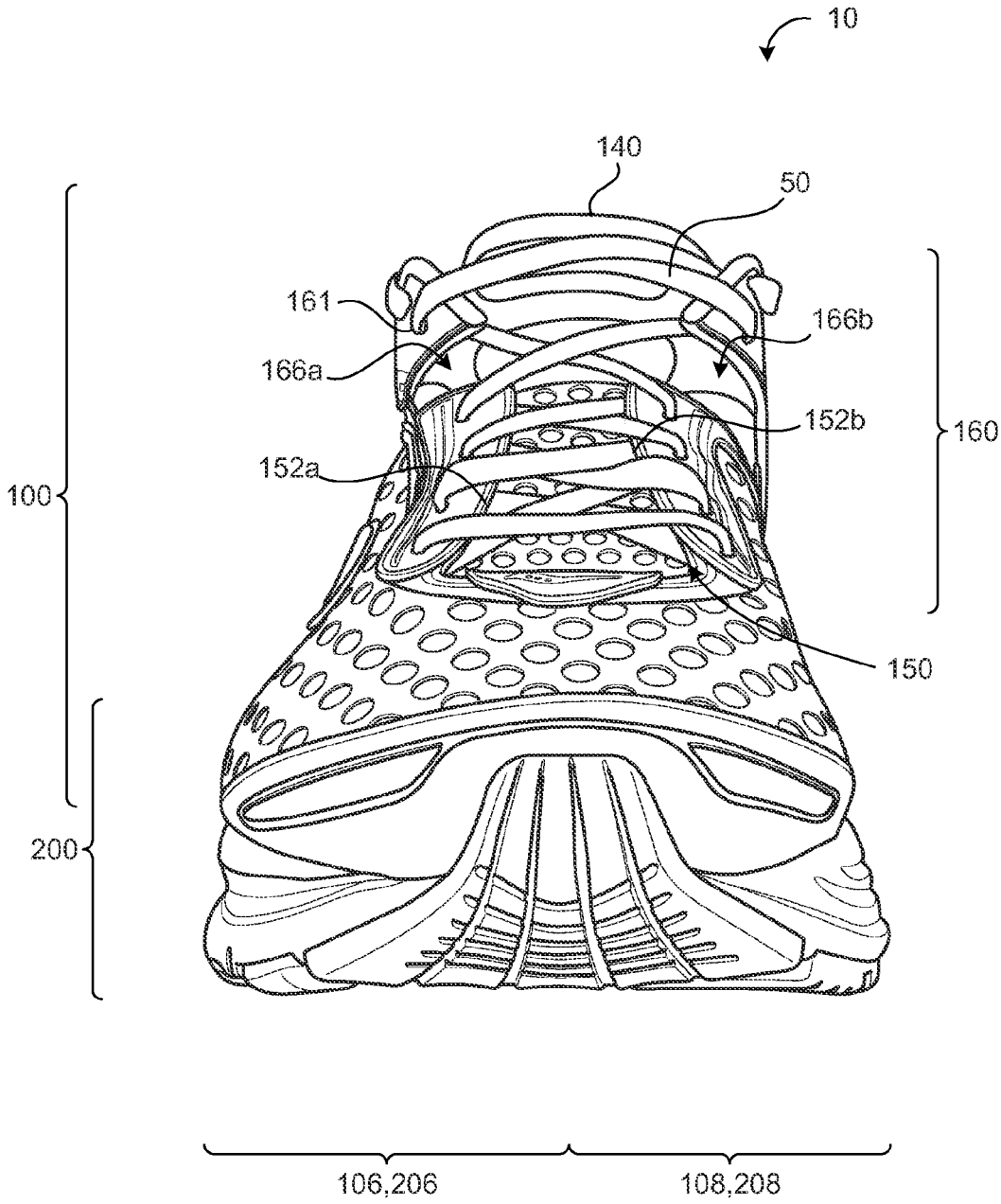
FIG. 4 is a front view of the article of footwear shown in FIG. 1.
Figure 5:
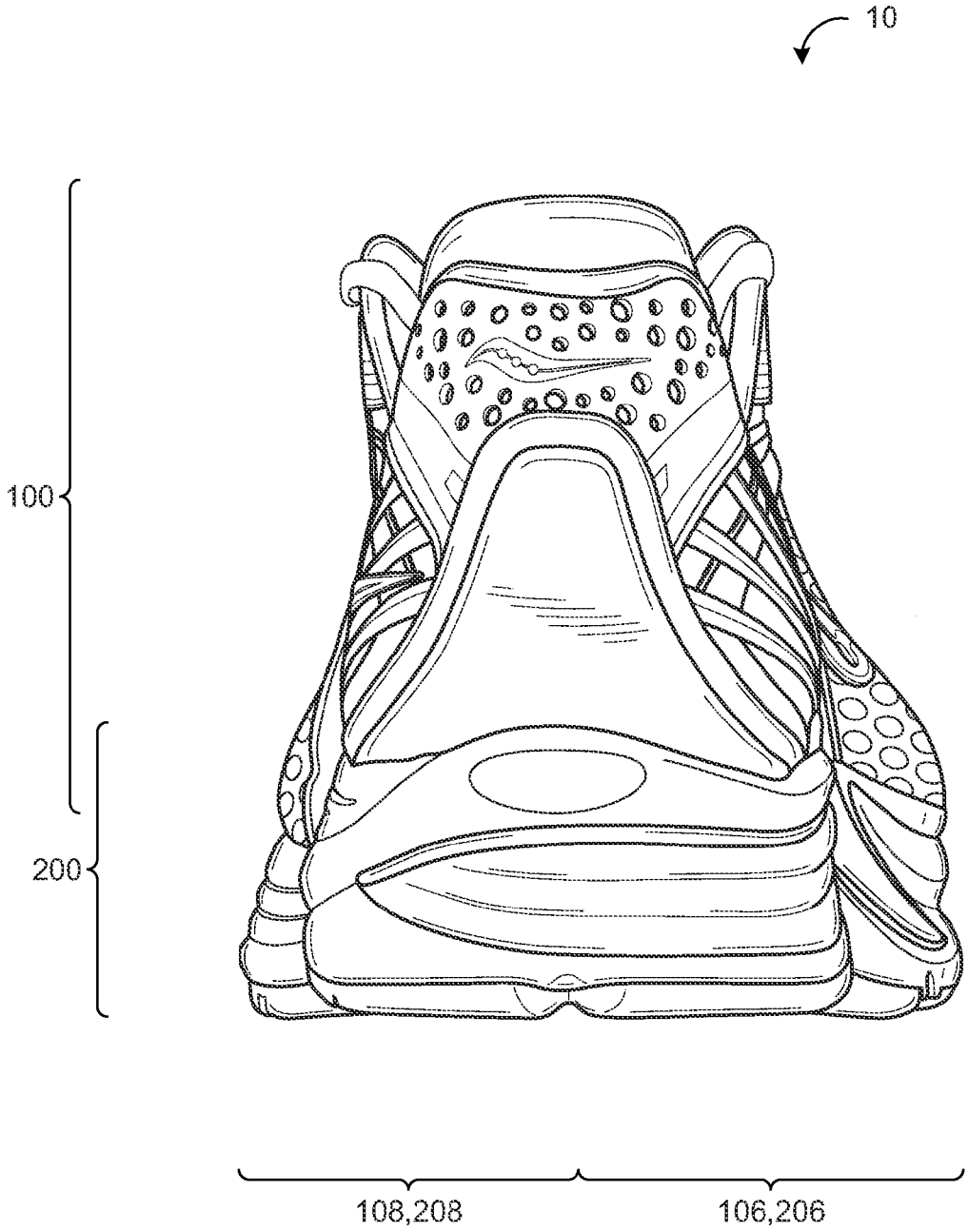
FIG. 5 is a rear view of the article of footwear shown in FIG. 1.
Figure 6:
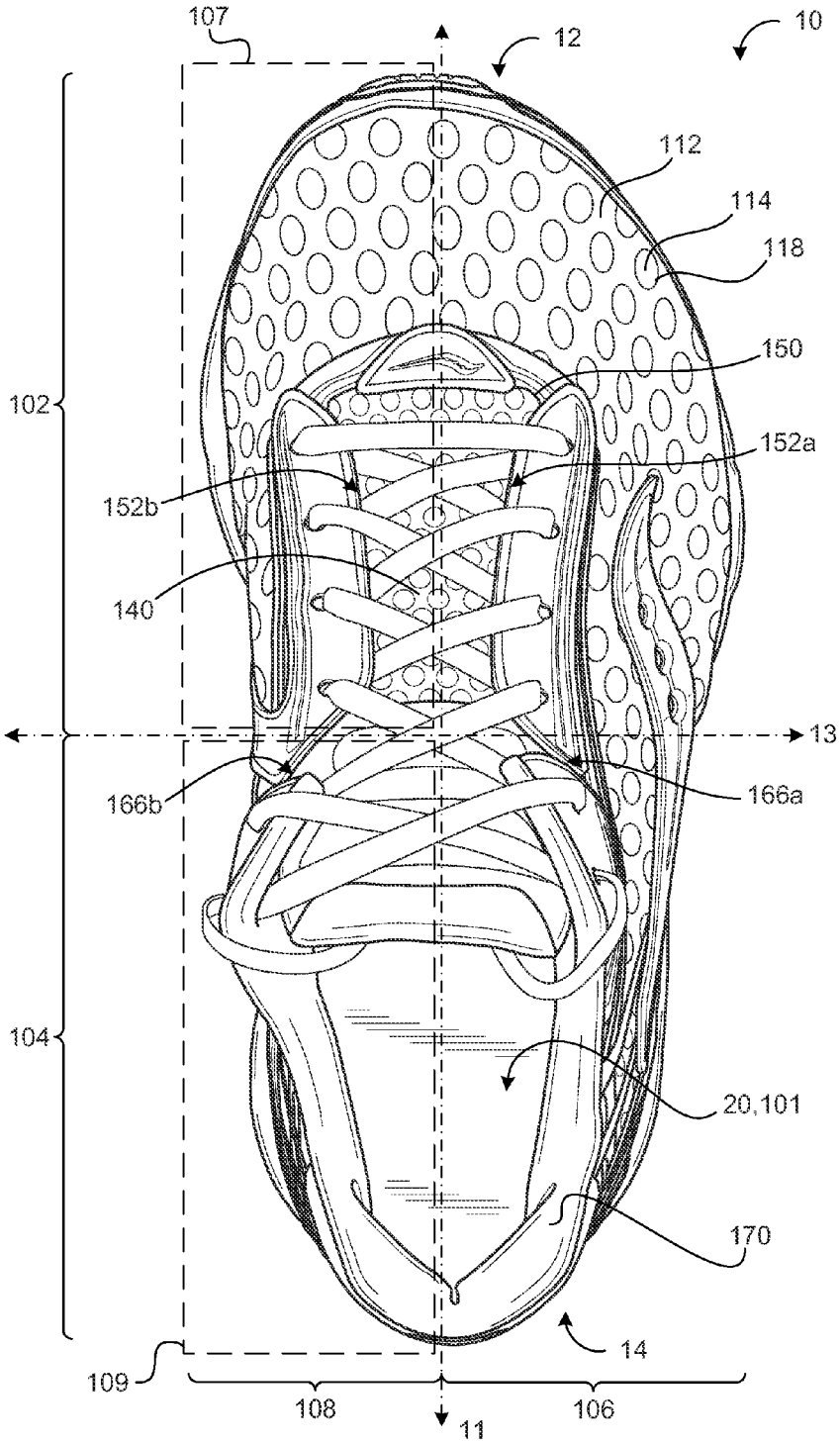
FIG. 6 is a top view of the article of footwear shown in FIG. 1.
Figure 7:
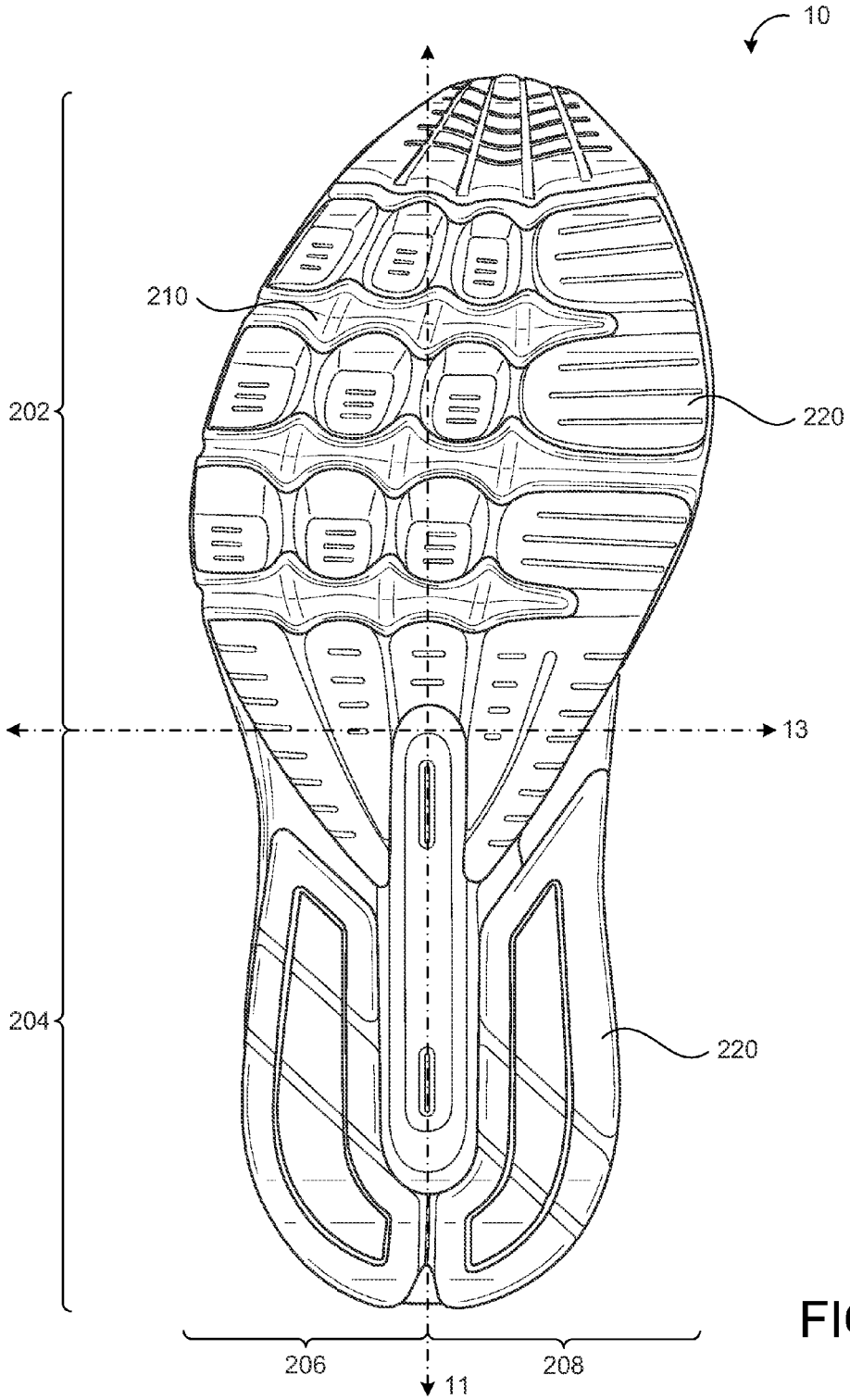
FIG. 7 is a bottom view of the article of footwear shown in FIG. 1.
Figure 8:
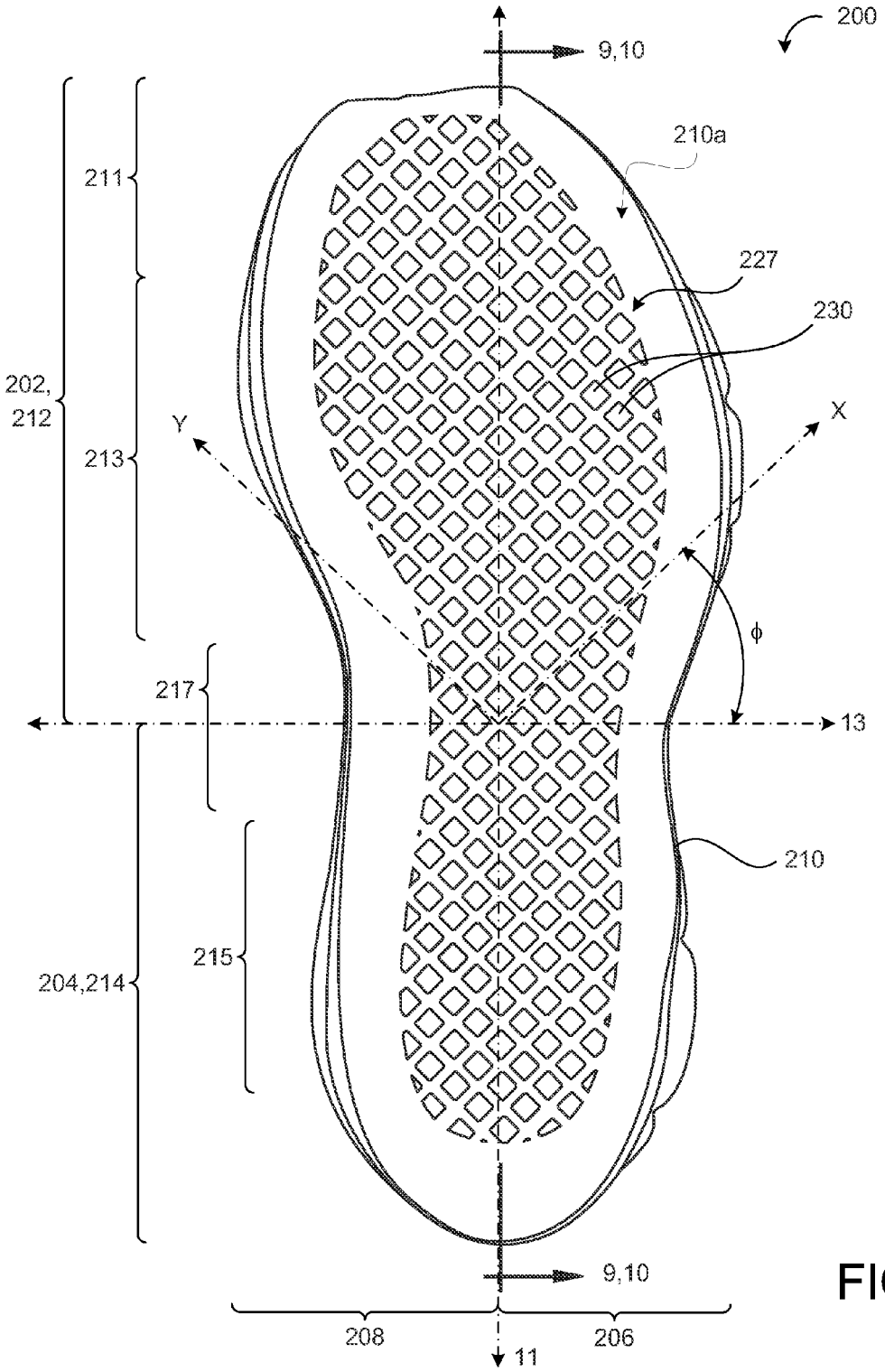
FIG. 8 is a top view of an exemplary sole assembly.

Referring to FIGS. 3 and 6, in some implementations, the forefoot upper assembly portion 102 can move relative to the heel upper assembly portion 104 in at least the medial portion 108 of the upper assembly 100. In the examples shown, the medial portion 108 of the upper assembly 100 includes a flex feature 120 that allows at least a medial forefoot portion 107 to move relative to at least a medial heel portion 109. This allows the upper assembly 100 to accommodate various foot movements during an assortment of activities, while maintaining a secure and comfortable fit. The flex feature 120 may extend from the sole assembly 200 to a lacing region 160. Moreover, a longitudinal axis 121 defined by the flex feature 120 may be arranged at an angle θ with respect to a ground contact surface 205 of the sole assembly 200 of between about 30° and about 90°. In the examples shown, the flex feature 120 is angled toward the heel end 14 of the shoe 10. In some examples the flex feature 120 has a linear shape, while in other examples, the flex feature 120 has an arcuate shape. The flex feature 120 may comprise a forward portion **122*a* and a heelward portion 122*b* connected by an stretch portion 124 therebetween. The stretch portion 124 may extend an entire length of the flex portion 120 or a portion thereof. The stretch portion 124 may comprise a stretchable or elastic material, such as a stretchable synthetic textile, stretch textile (e.g., mesh, three-dimensional mesh), rubber, polyurethane, or neoprene (polychloroprene, or any synthetic rubber produced by polymerization of chloroprene). The stretch portion 124 can have a width $W_S$ in a direction along the surface of the enclosure layer 110** of between about 2 mm and about 2 cm.

Referring to FIGS. 1-4, in the examples shown, a tongue 140 at least substantially covers a tongue opening 150 defined by the upper assembly 100. At least one tongue closure fastener 50 releasably connects lateral and medial sides **152*a*, 152*b* of the tongue opening 150. In the example shown, the tongue closure fastener 50 comprises laces; however, other configurations are possible as well, such as one or more straps, elastic bands, etc. A lacing region 160 substantially surrounding the tongue opening 150 may define eyelets 161 for receiving a lace 50. In some examples, a heelward portion 164 of the lacing region 160 proximate the foot opening 101 defines lateral and medial clefts 166*a*, 166*b* allowing articulation or independent movement of the heelward portion 164 of the lacing region 160 with respect to a forward portion 162 of the lacing region 160. The clefts 166*a*, 166*b* can separate the forward and heel portions 162, 164 of the lacing region 160. This allows the heelward lacing region portion 164 to wrap around a talus region of a received foot, thus providing a comfortable and secure fit during lacing of the shoe 10. In the examples shown, the medial cleft 166*b* extends from the tongue opening 150 to the sole assembly 200, separating the medial forefoot portion 107 of the upper assembly 100 from the medial heel portion 109 of the upper assembly 100, allowing movement between the respective portions. The flex feature 120 may join the medial forefoot and medial heel portions 107, 109 of the upper assembly 100. Although the flex feature 120 terminates outside of the lacing region 160 in the example shown, the flex feature 120 may alternatively extend through the lacing region 160**.

Referring to FIG. 6, in some implementations, the upper assembly 100 includes a contoured foam layer 170 disposed in the foot opening 101 shaped to anatomically fit and cushion a received heel or heel and ankle of a user. The foam layer 170 may comprise an ethylene vinyl acetate foam or other suitable foam material. In some examples, the contoured foam layer 170 defines an embossed pattern that aids the anatomical fit around the received foot.

Referring to FIGS. 1-3 and 7-10, in some implementations, the sole assembly 200 includes a midsole 210 disposed on an outsole 220. The outsole 220 may comprise rubber, or any other suitable material (e.g., a wear resistant material). For example, the outsole 220 may comprise an injection blown rubber, which may be at least 15% more resilient than regular blown rubber. The midsole 210 may comprise ethylene vinyl acetate (EVA) (e.g., an EVA foam or an injection molded EVA) or any other material for cushioning. The midsole 210 may be configured to provide different levels of cushioning and bending in different regions of the sole assembly 200. In some implementations, the midsole 210 defines cavities or voids 230 of different sizes (e.g., cross-sectional area A and/or depth D) along the midsole 210 (e.g., between forefoot and heel portions 222, 224 of the midsole 210). The voids 230 may define a square, rectangular, polygonal, circular, or elliptical cross-sectional shape. Other shapes are possible as well. The voids 230 are arranged to allow the midsole 210 to deform (e.g., elastically) to provide relatively greater levels of localized cushioning and bending in various portions of the midsole 210. Some voids 230 may have one shape or size conducive for facilitating bending of the sole assembly 100 in a corresponding portion of the sole assembly 200, while other voids 230 may have another shape or size conducive for providing a certain level of cushioning in that corresponding portion of the sole assembly 200. Moreover, the voids 230 may be arranged in a random or ordered manner. The voids 230 may envelop at least 50% of a surface area of a top surface 210*a* of the midsole 210.

In some examples, voids 230 near a periphery (i.e., perimeter) of the midsole 210 have relatively smaller cross-sectional areas A and/or relatively shallower depths D than voids 230 inward away from the periphery (e.g., greater than 1 cm inward from the perimeter of the midsole 210). Relatively larger and deeper voids 230 in primary weight bearing areas of the sole assembly 200 can provide relatively greater levels of cushioning in those areas.

The midsole 210 includes a phalanges or toe portion 211, a metatarsus portion 213, and a calcaneus portion 215. The phalanges midsole portion 211 is positioned to receive a corresponding phalanges portion of a received foot. Similarly, the metatarsus midsole portion 213 is positioned to receive a corresponding metatarsus portion of a received foot. The calcaneus midsole portion 215 is positioned to receive a corresponding calcaneus portion of a received foot. The phalanges, metatarsus, and calcaneus midsole portions, 211, 213, 215 can be sized and positioned to substantially receive the corresponding portions of a received foot (i.e., there may not be a direct alignment between the two).

In some implementations, voids 230 defined in the metatarsus portion 213 of the midsole 210 have at least one of a larger cross-sectional area A and a deeper depth D than voids 230 defined in the heel portion 214. Moreover, voids 230 defined in the metatarsus midsole portion 213 may have at least one of a larger cross-sectional area A and a deeper depth D than voids 230 defined in the phalanges midsole portion 211. Voids 230 defined in the metatarsus midsole portion 213 may have at least one of a larger cross-sectional area A and a deeper depth D than voids 230 defined in at least one of the phalanges midsole portion 211, the calcaneus midsole 215, and an arch midsole portion 217 (between the metatarsus and calcaneus portions).

In some implementations, voids 230 defined in the calcaneus midsole portion 215 have at least one of a larger cross-sectional area A and a deeper depth D than voids 230 defined in the metatarsus midsole portion 213 (e.g., to provide relatively greater heel cushioning than other portions of the midsole 210). In some examples, voids 230 defined in the metatarsus and calcaneus portions 213, 215 of the midsole 210 have at least one of a larger cross-sectional area A and a deeper depth D than any remaining voids 230 defined by the midsole 210. Voids 230 defined near a periphery of the midsole 210 may have at least one of a smaller cross-sectional area A and a shallower depth D than any remaining voids 230 defined by the midsole 210.

Voids 230 defined in the metatarsus and calcaneus portions 213, 215 of the midsole 210 may have a cross-sectional area A of between about 4 $mm^2$ and about 100 $mm^2$. Voids 230 defined in the phalanges midsole portion 211 and the arch midsole portion 217 may have a cross-sectional area A of between about 4 $mm^2$ and about 25 $mm^2$. Voids defined in the metatarsus and calcaneus portions of the midsole body have a depth of between about 4 mm and about 10 mm and voids defined in the phalanges portion 211 and the arch portion 217 of the midsole have a depth of between about 1 mm and about 5 mm. Voids defined in the metatarsus and calcaneus portions 213, 215 of the midsole 210 may have a depth D of between about 45% and 90% a thickness T of the midsole 210.

Figure 9:
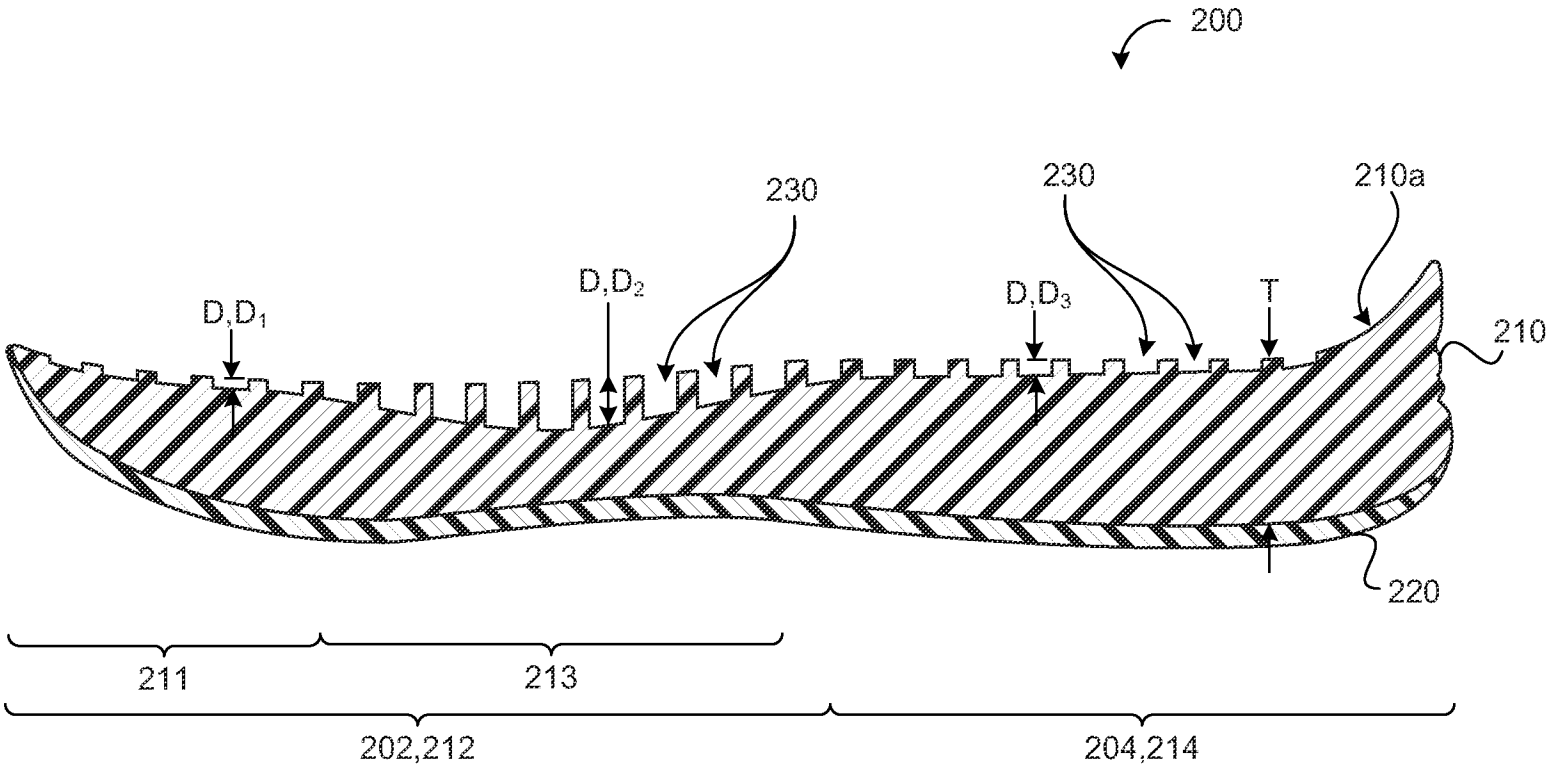
FIG. 9 is a section view of the sole assembly shown in FIG. 8 along line 9-9.
Figure 10:
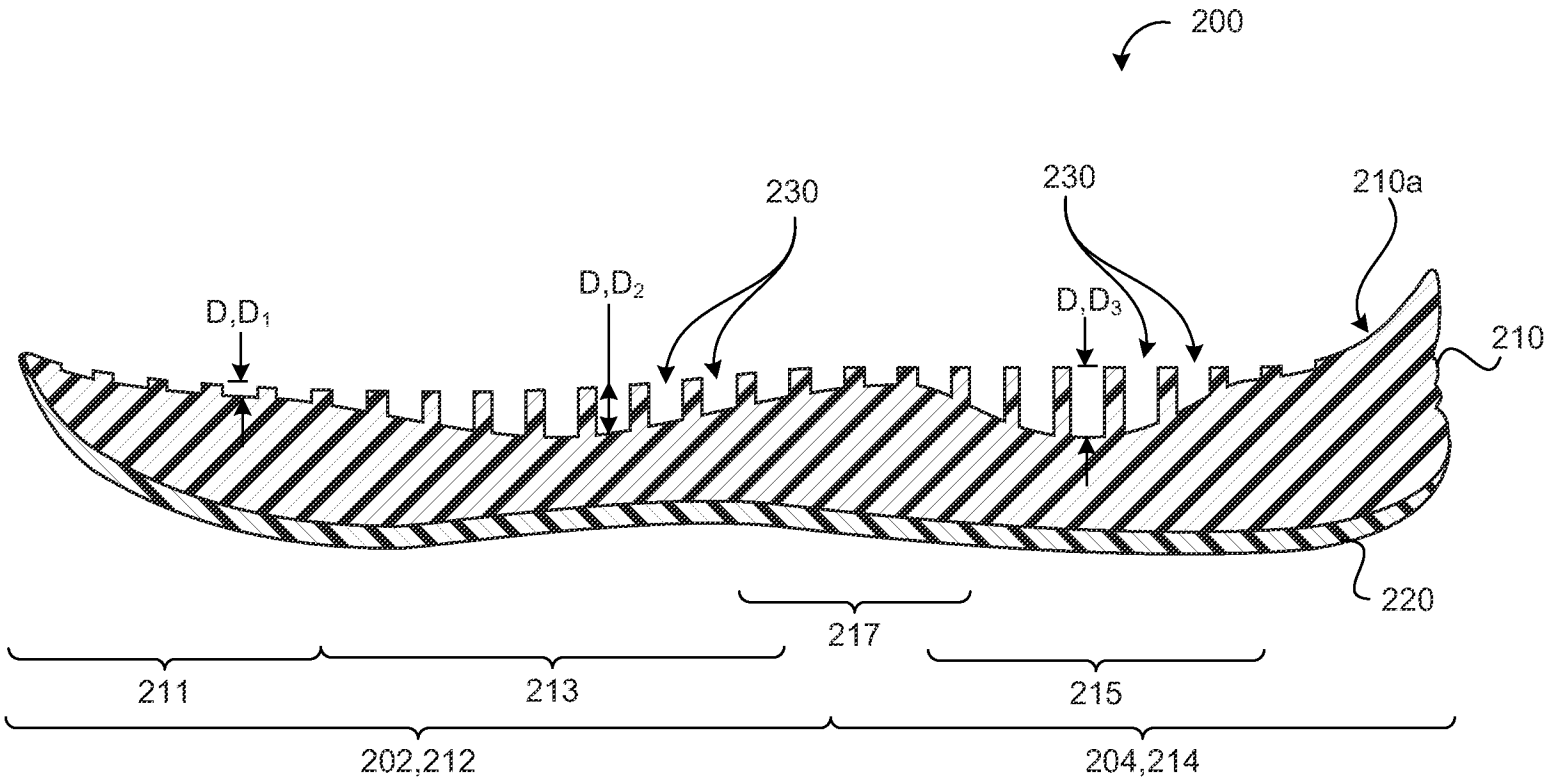
FIG. 10 is a section view of the sole assembly shown in FIG. 8 along line 10-10.
Figure 11:
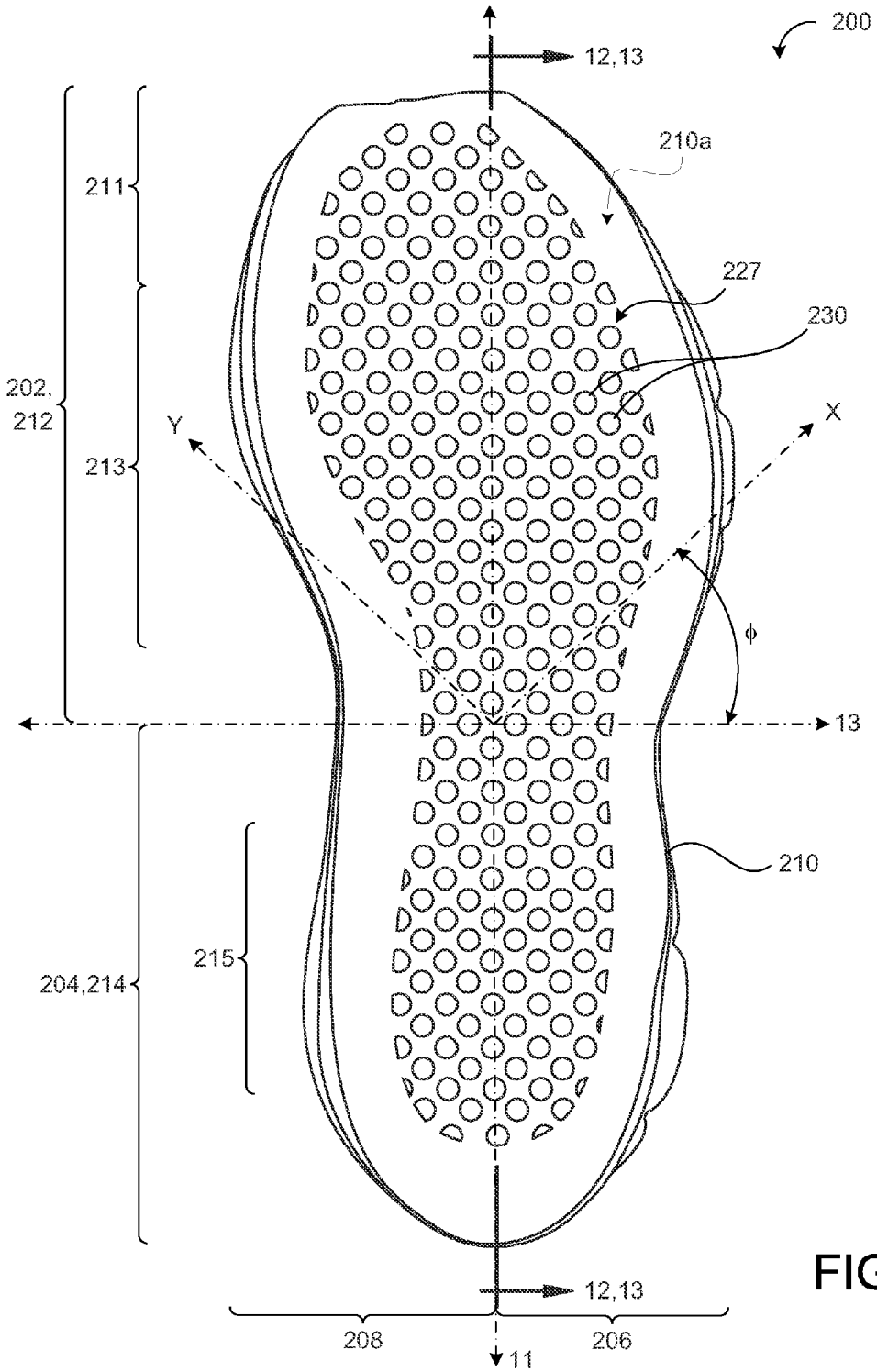
FIG. 11 is a top view of an exemplary sole assembly.

In the examples shown in FIGS. 8-13, the midsole 210 defines a two-dimensional array or grid 227 of voids 230 having a substantially square cross-sectional shape (FIG. 8) or a substantially circular cross-sectional shape (FIG. 11). Other cross-sectional shapes may be used alternatively or as well. The grid 227 of voids 230 has perpendicular X and Y axes arranged such that the X axis has an angle $\phi$ of about 45° with respect to the transverse axis 13 of the shoe 10. Other arrangements are possible as well, such as any angle $\phi$ of between 0° and 90° with respect to the transverse axis 13.

Figure 12:
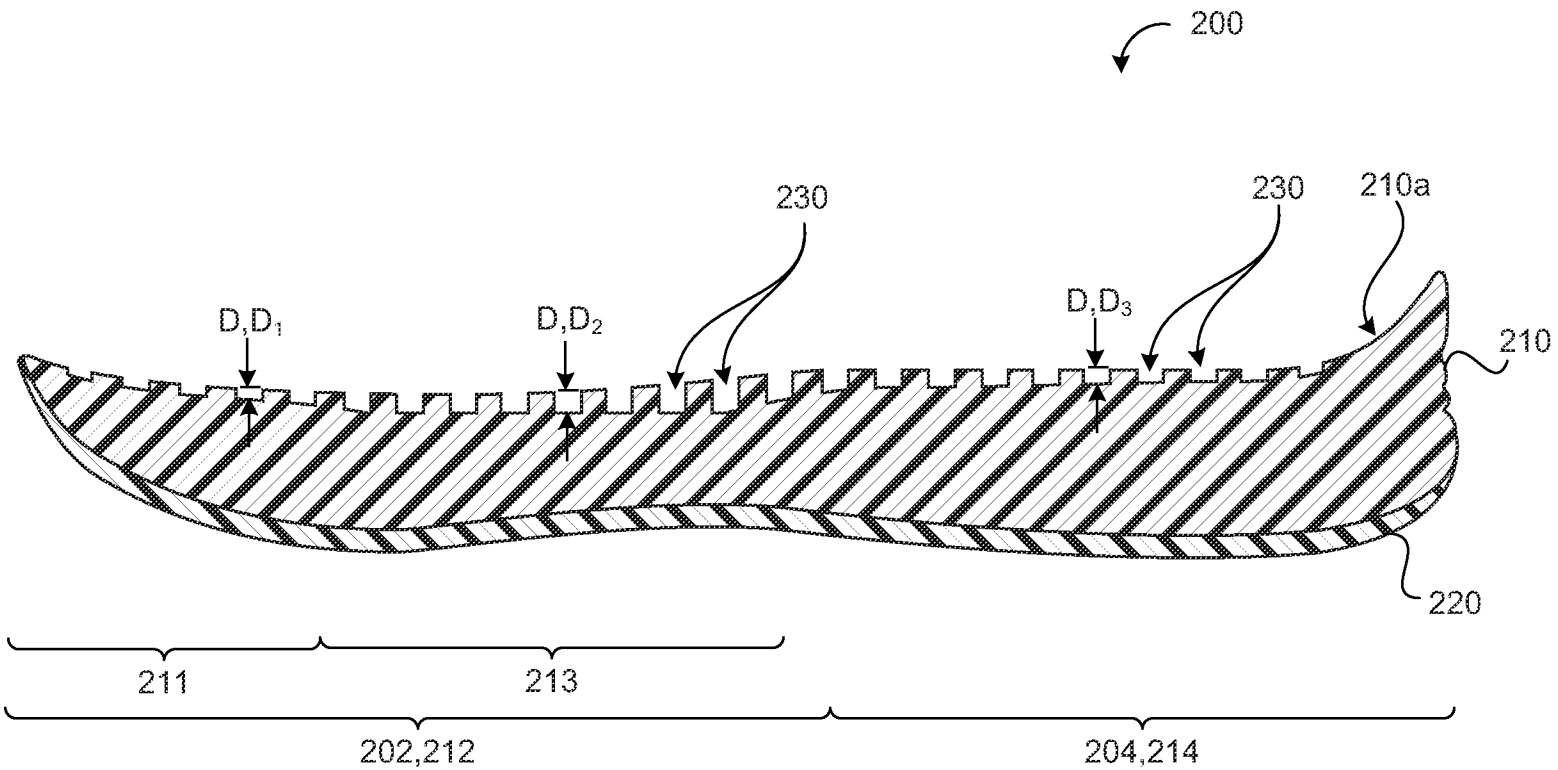
FIG. 12 is a section view of the sole assembly shown in FIG. 11 along line 12-12.

In the examples shown in FIGS. 9 and 12, the voids 230 define relative deeper depths D in a forefoot portion 212 of the midsole 210 than in a heel portion 214 of the midsole 210. The midsole 200 defines voids 230 having a first depth $D_1$ in the phalanges or toe portion 211, a second depth $D_2$ in the metatarsus portion 213 and a third depth $D_3$ in the heel midsole portion 214. Moreover, as shown, the depths D of the voids 230 may smoothly transition between the adjacent midsole portions 211, 213, 214 (e.g., to provide a gradual transition in feel by the received foot). In some examples, the second void depth $D_2$ is greater than the first and third void depths $D_1$, $D_3$ and the third void depth $D_3$ is greater than the first void depth $D_1$. Relatively deeper voids 230 in the metatarsus midsole portion 213 provides relatively greater cushioning and less bending resistance in that portion as compared to the other portions of the midsole 210. The first void depth $D_1$ may be between about 1 mm and about 3 mm. The second void depth $D_2$ may be between about 3 mm and about 15 mm. The third void depth $D_3$ may be between about 1 mm and about 10 mm.

Figure 13:
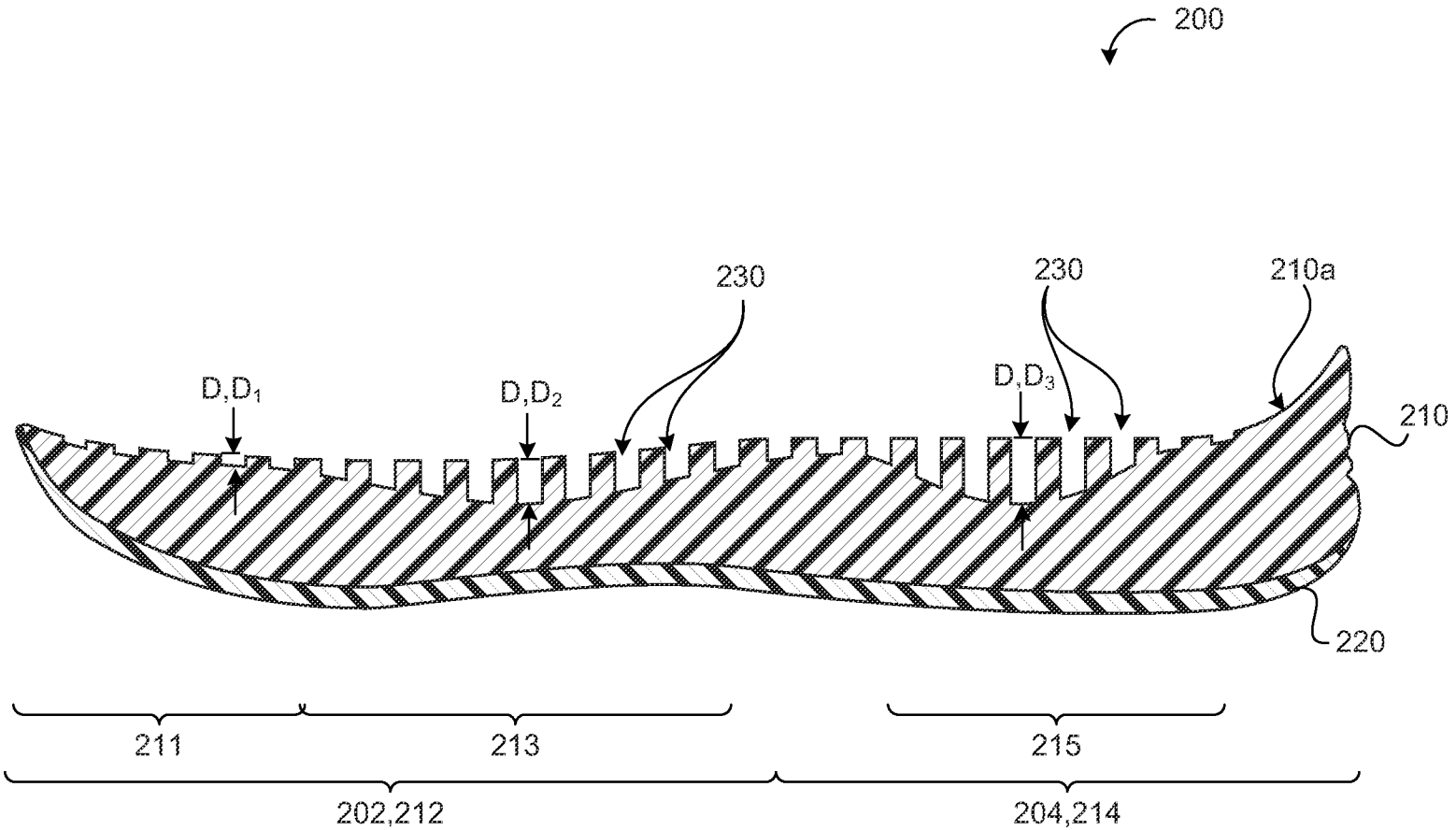
FIG. 13 is a section view of the sole assembly shown in FIG. 11 along line 13-13.
Figure 14:
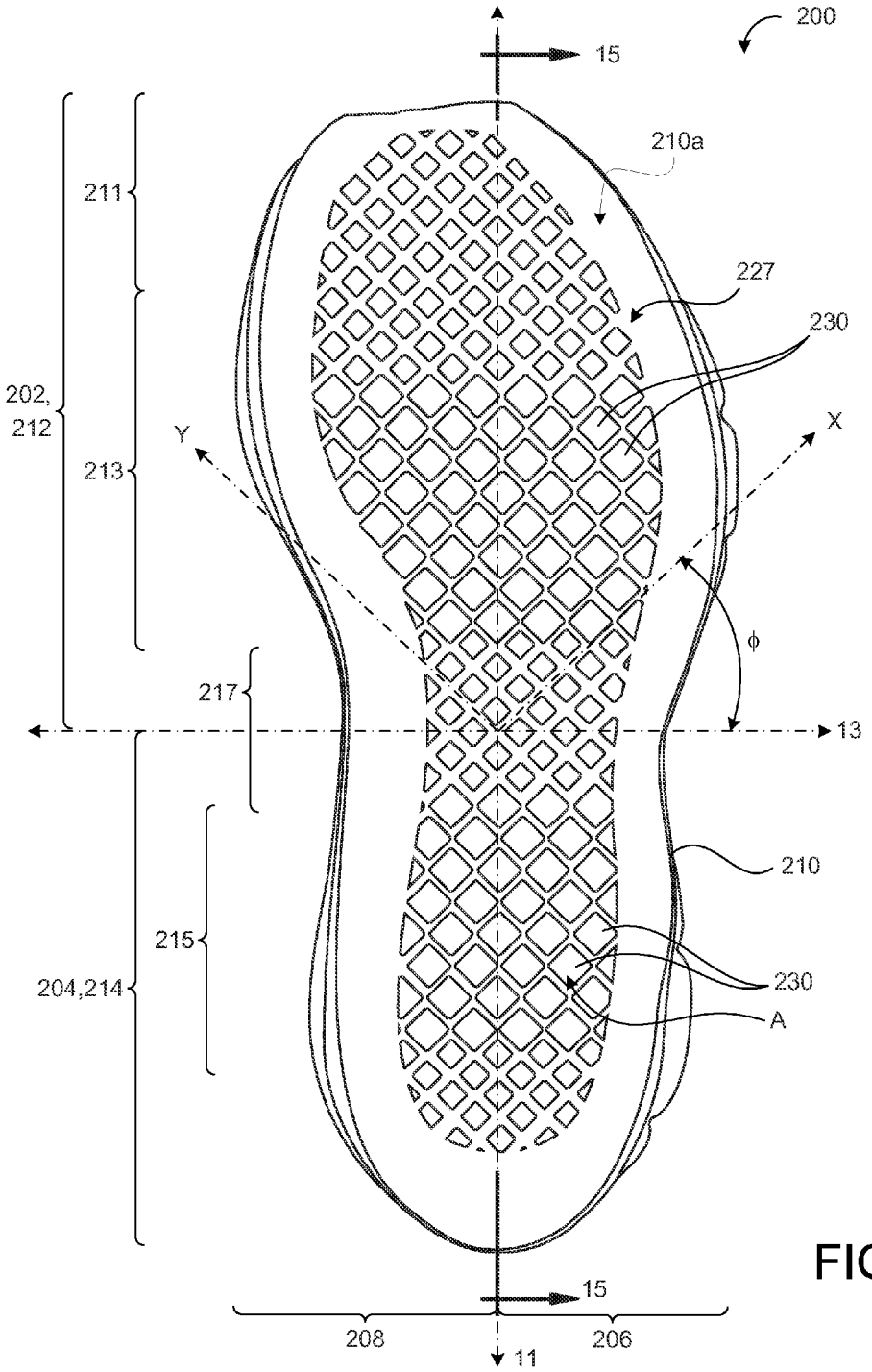
FIG. 14 is a top view of an exemplary sole assembly.
Figure 15:
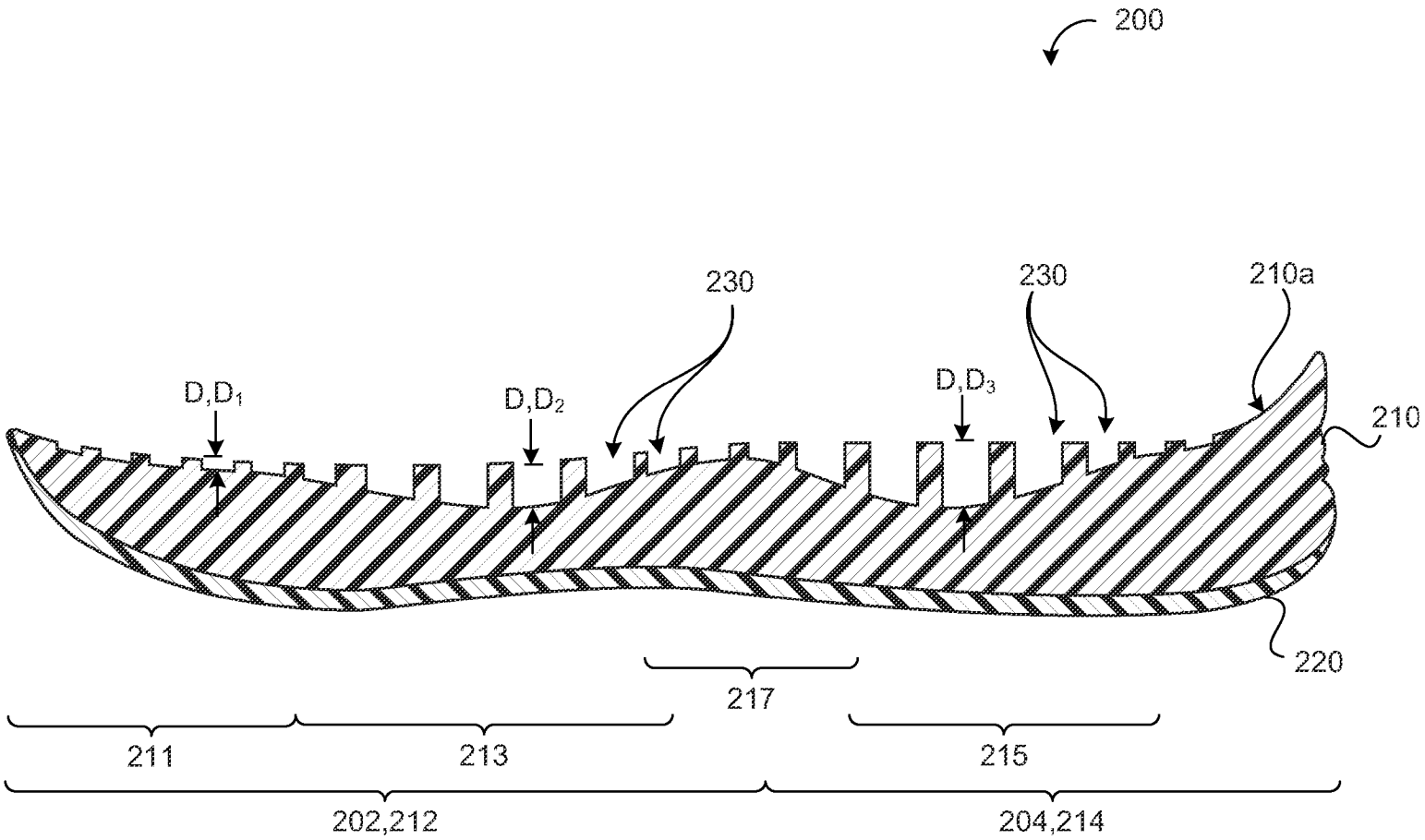
FIG. 15 is a section view of the sole assembly shown in FIG. 14 along line 15-15.

In the examples shown in FIGS. 10 and 13, the voids 230 define relative deeper depths D in both the metatarsus midsole portion 213 and the calcaneus portion 215 of the midsole 210 in the heel midsole portion 214. The midsole 200 defines voids 230 having a first depth $D_1$ in the phalanges midsole portion 211, a second depth $D_2$ in the metatarsus midsole portion 213 and a third depth $D_3$ in the calcaneus midsole portion 215. Moreover, as shown, the depths D of the voids 230 may transition gradually between the adjacent midsole portions 211, 213, 215 (e.g., to provide a gradual transition in feel by the received foot). In some examples, the third void depth $D_3$ is greater than the first and second void depths $D_1$, $D_2$ and the second void depth $D_2$ is greater than the first void depth $D_1$. Relatively deeper voids 230 in the calcaneus midsole portion 215 provides relatively greater cushioning in the heel portion 204 of the sole assembly 200, as compared to the other portions. Furthermore, relatively deeper voids 230 in the metatarsus midsole portion 213 providers relatively greater cushioning and less bending resistance in that portion as compared to the other portions of the midsole 210. In some examples, the voids 230 in the metatarsus midsole portion 213 having a substantially equal depth D as the voids 230 in the calcaneus midsole portion 215. The first void depth $D_1$ may be between about 1 mm and about 3 mm. The second void depth $D_2$ may be between about 3 mm and about 15 mm. The third void depth $D_3$ may be between about 5 mm and about 15 mm.

Figure 16:
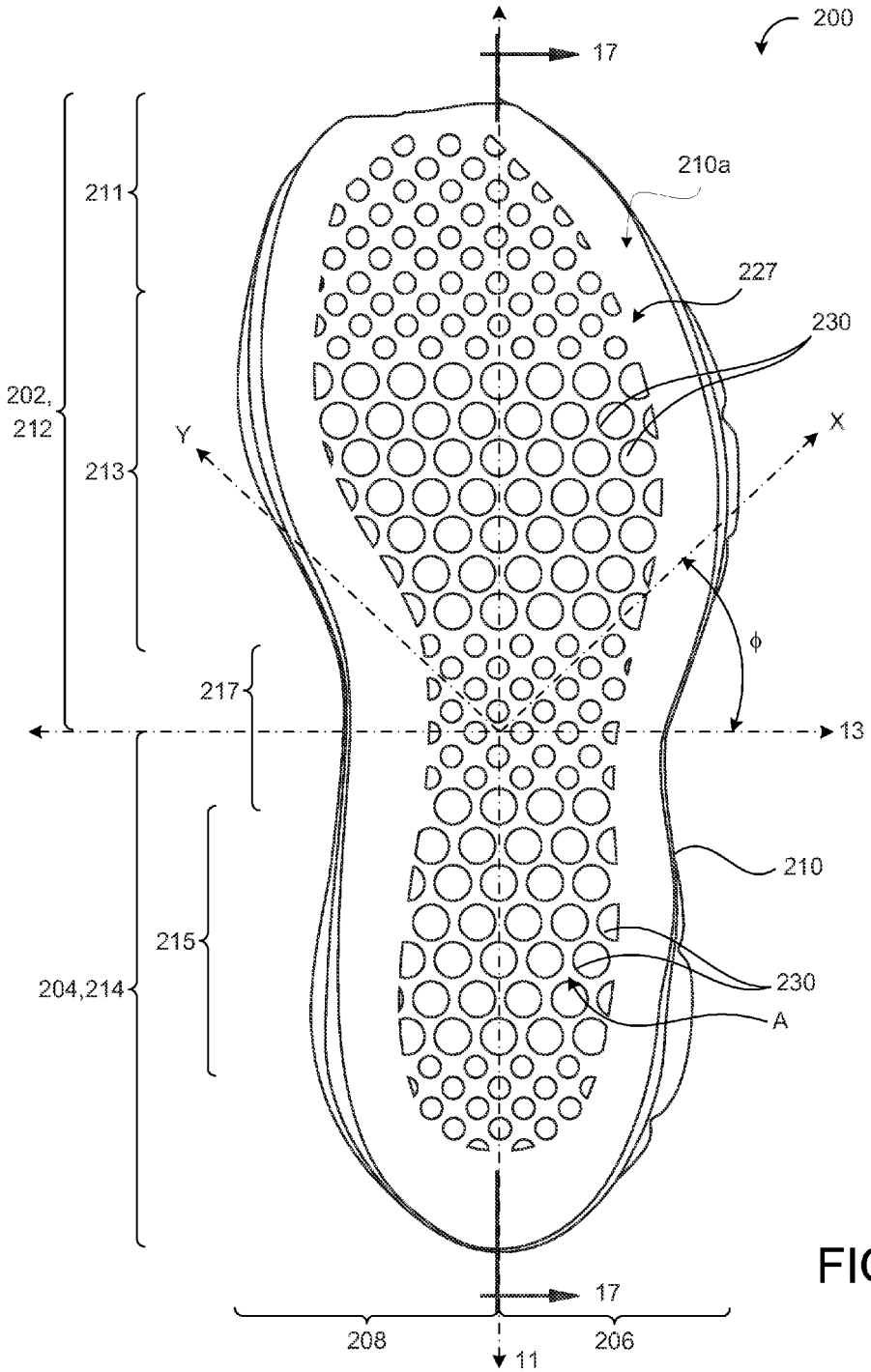
FIG. 16 is a top view of an exemplary sole assembly.
Figure 17:
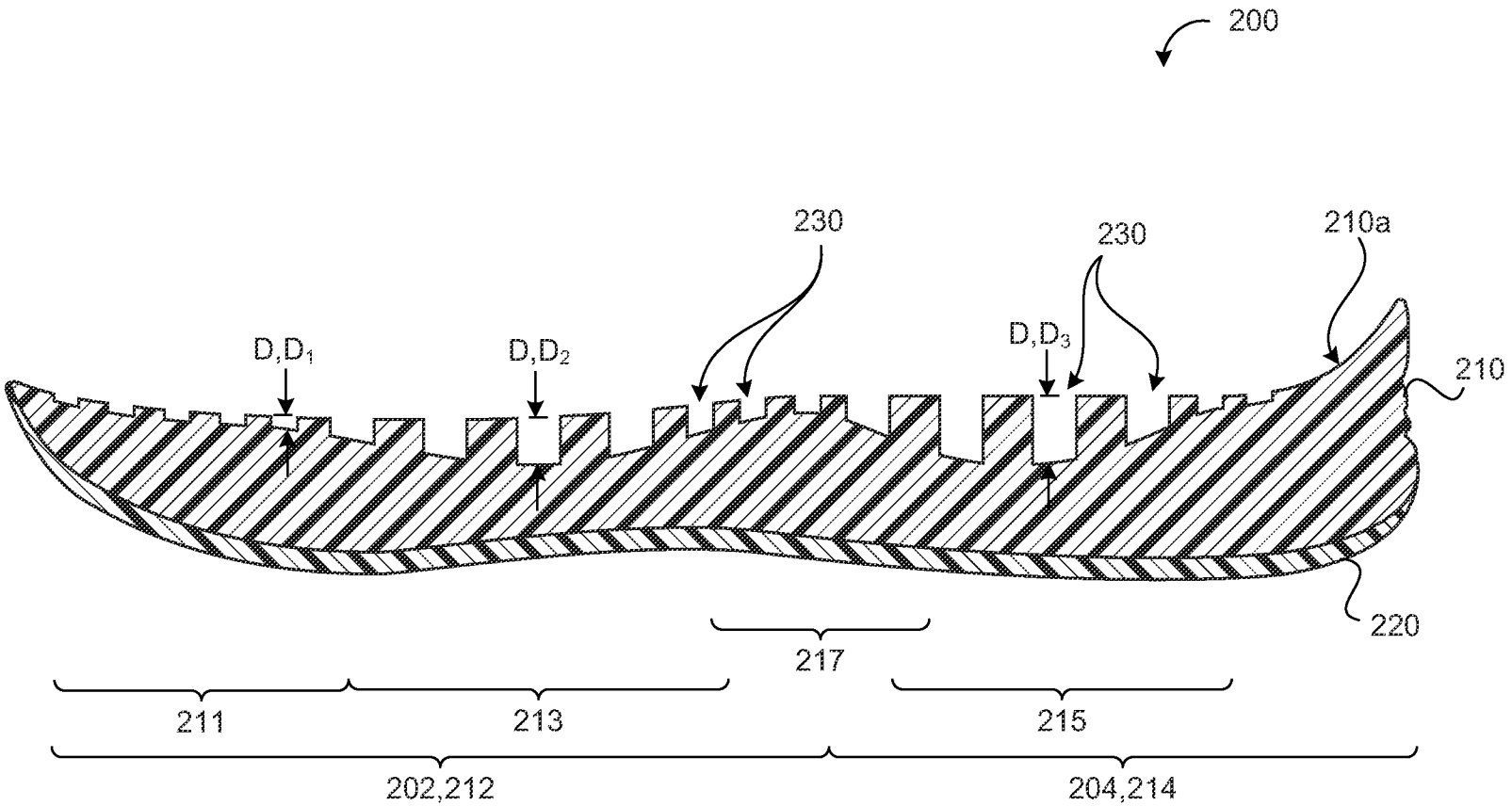
FIG. 17 is a section view of the sole assembly shown in FIG. 16 along line 17-17.

In the examples shown in FIGS. 14-17, the midsole 210 defines a two-dimensional array or grid 227 of voids 230 having a substantially square cross-sectional shape (FIG. 14) or a substantially circular shape (FIG. 16). As with the other examples, other cross-sectional void shapes by be used alternatively or as well. The grid 227 of voids 230 has perpendicular X and Y axes arranged such that the X axis has an angle $\phi$ of about 45° with respect to the transverse axis 13 of the shoe 10. Other arrangements are possible as well, such as any angle $\phi$ of between 0° and 90° with respect to the transverse axis 13. The voids 230 define relative larger cross-sectional areas A and deeper depths D in both the metatarsus midsole portion 213 and the calcaneus midsole portion 215 (e.g., for providing relatively larger amounts of cushioning and bend-ability in those portions). The midsole 200 defines voids 230 having a first cross-sectional area $A_1$ and a first void depth $D_1$ in the phalanges midsole portion 211, a second cross-sectional area $A_2$ and a second void depth $D_2$ in the metatarsus midsole portion 213, and a third cross-sectional area $A_3$ and a third void depth $D_3$ in the calcaneus midsole portion 215. Moreover, as shown, the cross-sectional areas A and depths D of the voids 230 may transition gradually between the adjacent midsole portions 211, 213, 215 (e.g., to provide a gradual transition in feel by the received foot).

In some examples, the third void depth $D_3$ is greater than the first and second void depths $D_1$, $D_2$ and the second void depth $D_2$ is greater than the first void depth $D_1$. The second and third cross-sectional areas $A_1$, $A_2$ may be substantially equal to each other and/or both larger than the first cross-sectional area $A_1$. Relatively larger voids 230 in the calcaneus midsole portion 215 provides relatively greater cushioning in the heel portion 204 of the sole assembly 200, as compared to the other portions. Furthermore, relatively larger voids 230 in the metatarsus midsole portion 213 providers relatively greater cushioning and bend-ability in that portion as compared to the other portions of the midsole 210. In some examples, the voids 230 in the metatarsus midsole portion 213 have a substantially equal depth D as the voids 230 in the calcaneus midsole portion 215. The first void depth $D_1$ may be between about 1 mm and about 3 mm. The second void depth $D_2$ may be between about 3 mm and about 15 mm. The third void depth $D_3$ may be between about 5 mm and about 15 mm. The first cross-sectional area $A_1$ may be between about 4 $mm^2$ and about 9 $mm^2$. The second cross-sectional area $A_2$ may be between about 4 $mm^2$ and about 100 $mm^2$. The third cross-sectional area $A_3$ may be between about 4 $mm^2$ and about 100 $mm^2$. In some examples, voids 230 near a periphery of the midsole have relatively smaller cross-sectional areas A and/or relatively shallower depths D than voids 230 inward away from either a periphery of the midsole 210 (e.g., greater than 1 cm inward from the perimeter of the midsole 210) or the forward and rearward ends 12, 14 of the shoe 10.

Figure 18:
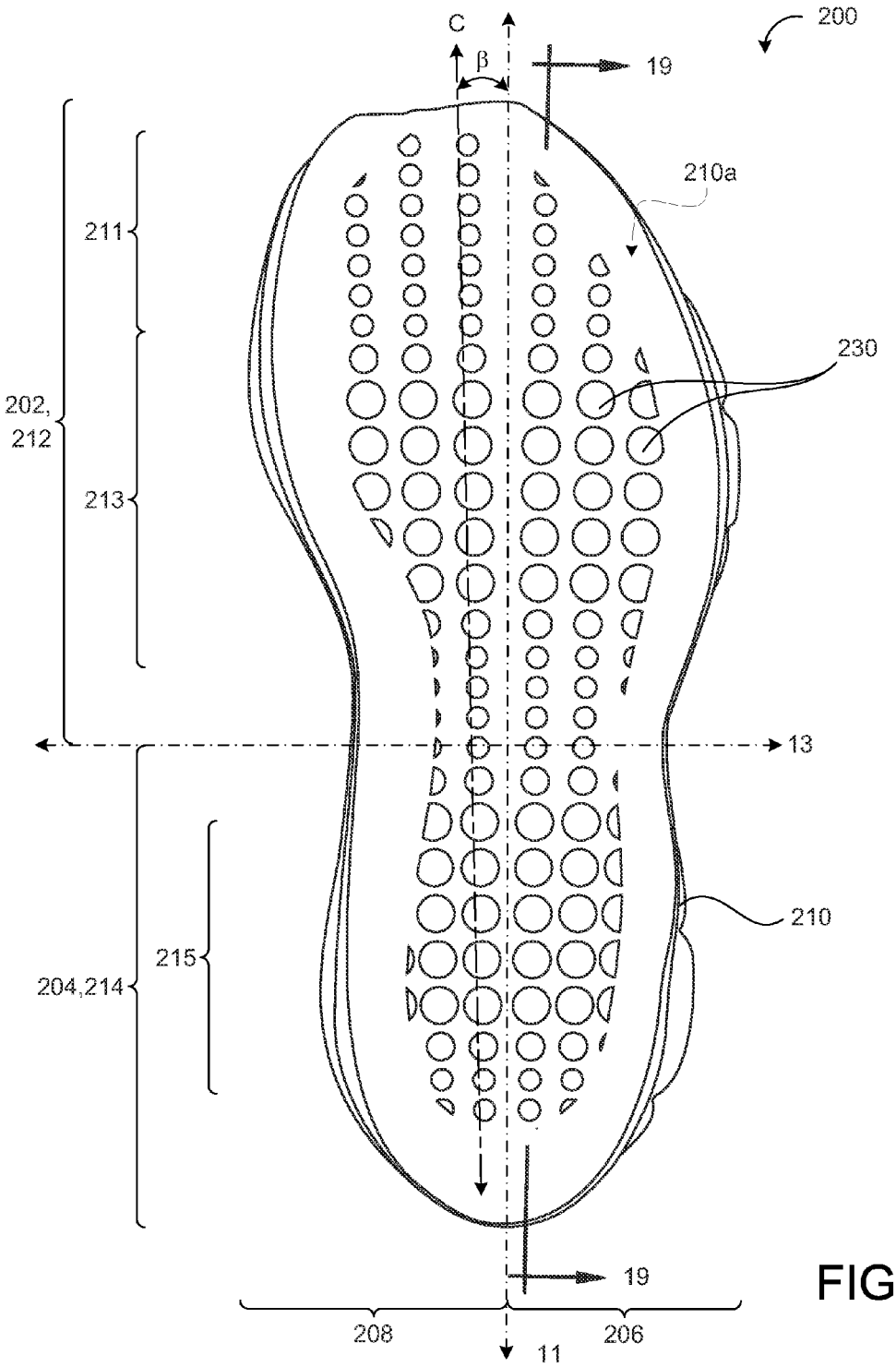
FIG. 18 is a top view of an exemplary sole assembly.
Figure 19:
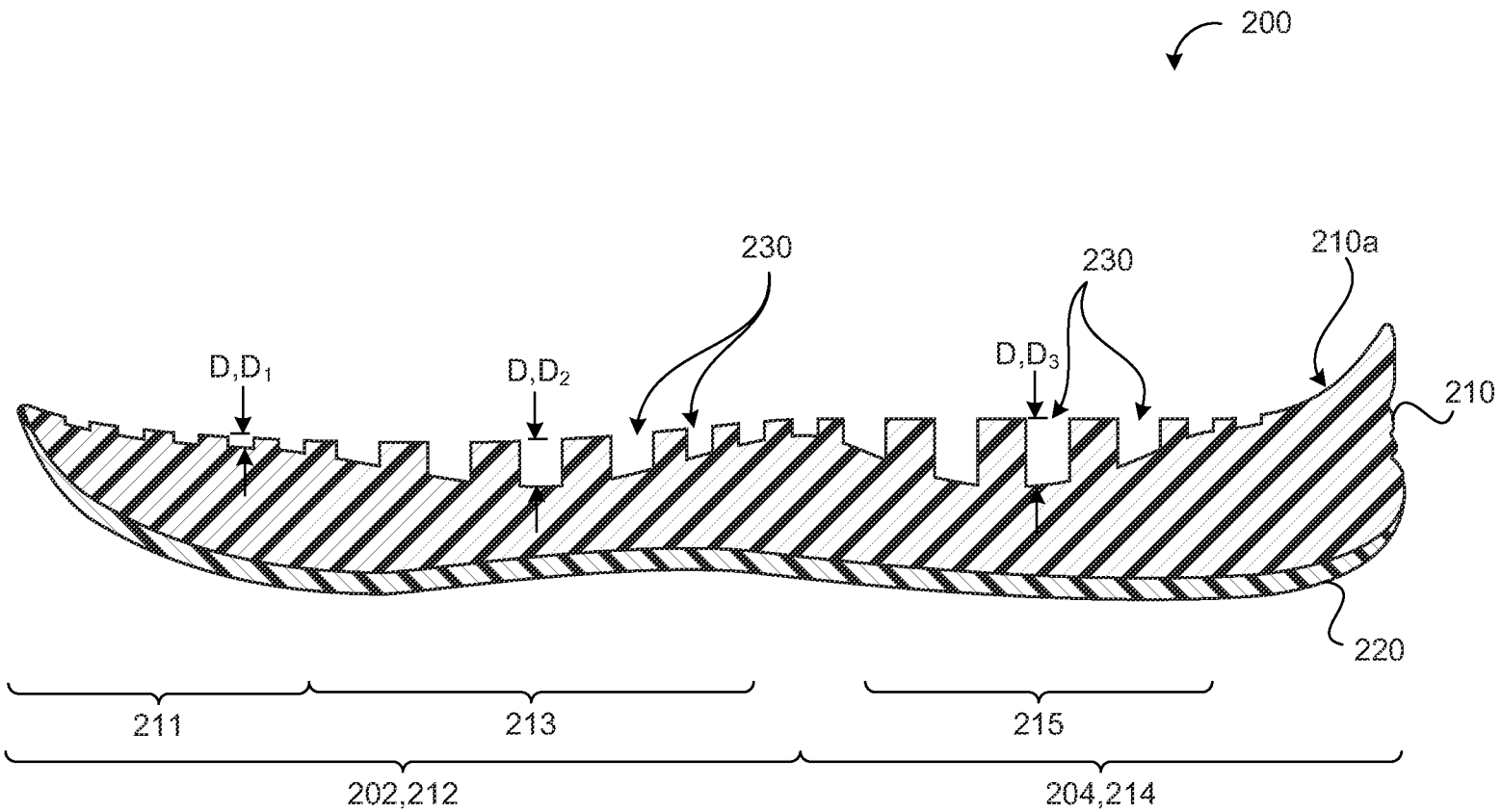
FIG. 19 is a section view of the sole assembly shown in FIG. 18 along line 19-19.

Referring to FIGS. 18 and 19, in some implementations, the midsole 210 defines columns C of voids 230 having a circular shape; however, other cross-sectional shapes are possible as well. The columns C of voids 230 may be arranged at an angle $\beta$ of between 0° and about 45° with respect to the longitudinal axis 11 of the shoe 10. In the example shown, the void columns C collectively define a fan pattern away from the longitudinal axis 11. The voids 230 define relative larger cross-sectional areas A and deeper depths D in both the metatarsus midsole portion 213 and the calcaneus midsole portion 215 (e.g., for providing relatively larger amounts of cushioning and bend-ability in those portions). The midsole 200 defines voids 230 having a first cross-sectional area $A_1$ and a first void depth $D_1$ in the phalanges midsole portion 211, a second cross-sectional area $A_2$ and a second void depth $D_2$ in the metatarsus midsole portion 213, and a third cross-sectional area $A_3$ and a third void depth $D_3$ in the calcaneus midsole portion 215. Moreover, as shown, the cross-sectional areas A and depths D of the voids 230 may transition gradually between the adjacent midsole portions 211, 213, 215 (e.g., to provide a gradual transition in feel by the received foot).

In some examples, the third void depth $D_3$ is greater than the first and second void depths $D_1$, $D_2$ and the second void depth $D_2$ is greater than the first void depth $D_1$. The second and third cross-sectional areas $A_1$, $A_2$ may be substantially equal to each other and/or both larger than the first cross-sectional area $A_1$. Relatively larger voids 230 in the calcaneus midsole portion 215 provides relatively greater cushioning in the heel portion 204 of the sole assembly, as compared to the other portions. Furthermore, relatively larger voids 230 in the metatarsus midsole portion 213 providers relatively greater cushioning and bend-ability in that portion as compared to the other portions of the midsole 210. In some examples, the voids 230 in the metatarsus midsole portion 213 having a substantially equal void depth D as the voids 230 in the calcaneus midsole portion 215. The first void depth $D_1$ may be between about 1 mm and about 3 mm. The second void depth $D_2$ may be between about 3 mm and about 15 mm. The third void depth $D_3$ may be between about 5 mm and about 15 mm. The first cross-sectional void are $A_1$ may be between about 4 $mm^2$ and about 9 $mm^2$. The second cross-sectional void are $A_2$ may be between about 4 $mm^2$ and about 100 $mm^2$. The third cross-sectional void are $A_3$ may be between about 4 $mm^2$ and about 100 $mm^2$.

Figure 20:
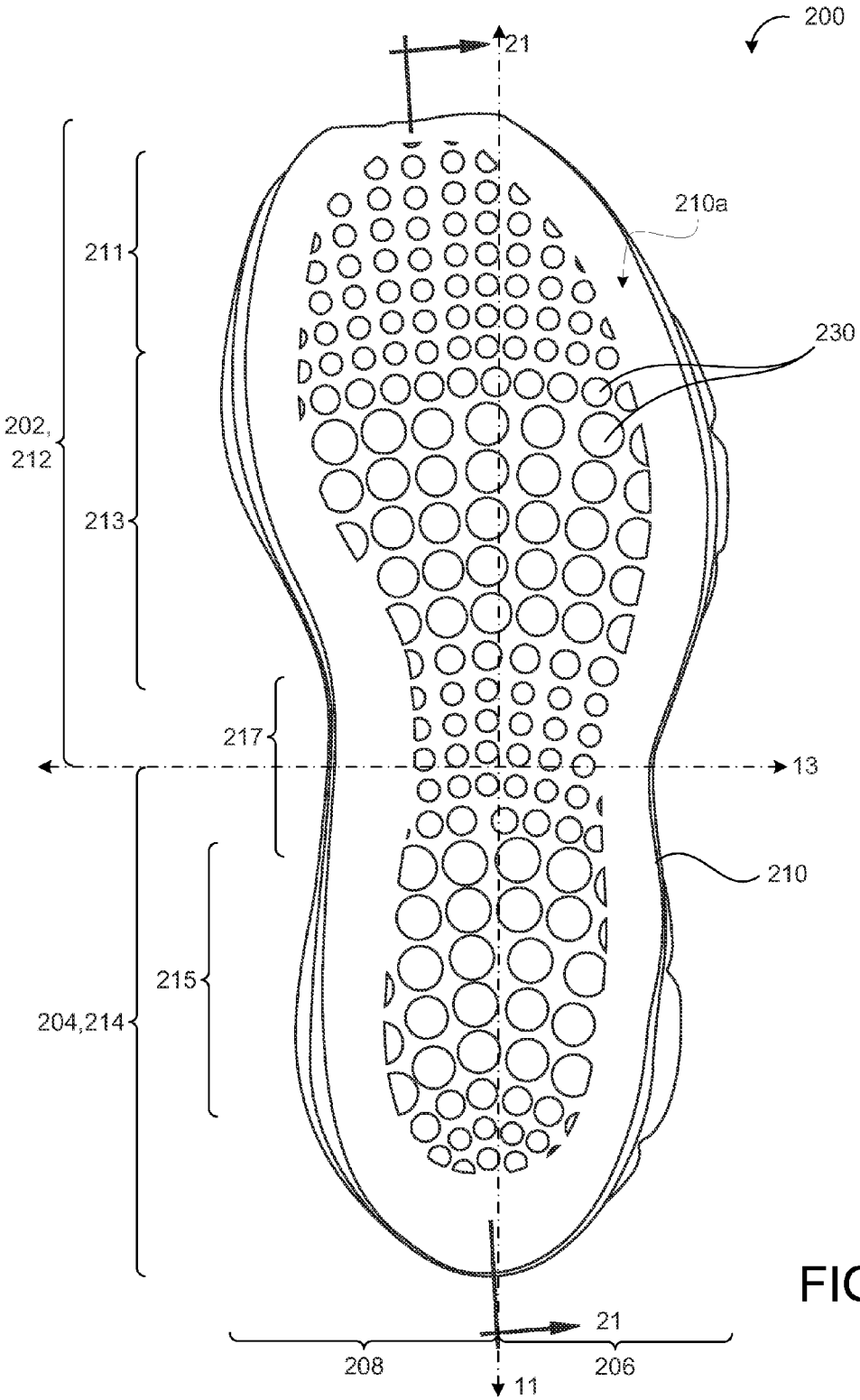
FIG. 20 is a top view of an exemplary sole assembly.
Figure 21:
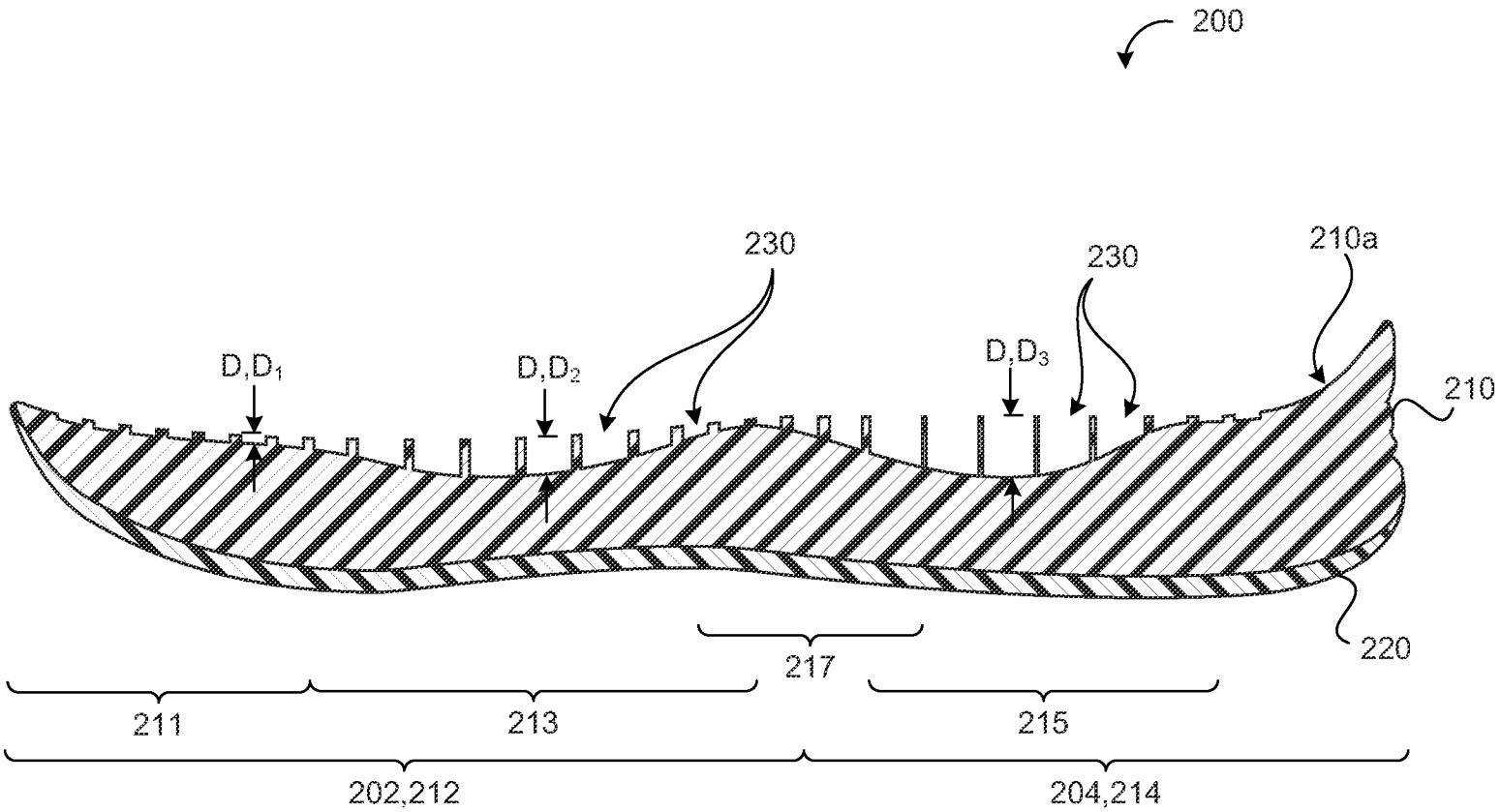
FIG. 21 is a section view of the sole assembly shown in FIG. 20 along line 21-21.

Referring to FIGS. 20 and 21, in some implementations, the midsole 210 defines different arrangements of voids 230 in each of the phalanges midsole portion 211, the metatarsus midsole portion 213, and the calcaneus midsole portion 215. The midsole 200 defines voids 230 having a first cross-sectional area $A_1$ and a first depth $D_1$ in the phalanges midsole portion 211, a second cross-sectional area $A_2$ and a second depth $D_2$ in the metatarsus midsole portion 213, and a third cross-sectional area $A_3$ and a third depth $D_3$ in the calcaneus midsole portion 215. Moreover, as shown, the cross-sectional areas A and depths D of the voids 230 may transition gradually between the adjacent midsole portions 211, 213, 215 (e.g., to provide a gradual transition in feel by the received foot). In the example shown, the second cross-sectional area $A_2$ of voids 230 in the metatarsus midsole portion 213 are substantially equal to the third cross-sectional area $A_3$ of voids 230 in the calcaneus midsole portion 215. Moreover, the third void depth $D_3$ is equal to or greater than the second void depth $D_2$. The remaining voids 230 in other midsole portions (i.e., not in the metatarsus midsole portion 213 or the calcaneus midsole portion 215) have relatively smaller cross-sectional areas A and shallower depths D. For example, voids 230 in an arch portion 217 (between the metatarsus midsole portion 213 and the calcaneus midsole portion 215) have smaller cross-sectional areas A and shallower depths D compared to the adjacent metatarsus and calcaneus midsole portions 213, 215 to provide relatively greater stiffness, support, and resistance to bending in the arch portion 217, so as to provide support under the received foot in that portion of the shoe assembly 200.

A number of implementations have been described. Nevertheless, it will be understood that various modifications may be made without departing from the spirit and scope of the disclosure. Accordingly, other implementations are within the scope of the following claims.

What is claimed is:

1. A midsole for an article of footwear, the midsole comprising a midsole body defining voids of different depths, the voids arranged to provide relatively greater cushioning and bendability within at least one of a metatarsus portion and a calcaneus portion of the midsole body;

wherein voids defined in the metatarsus portion of the midsole body have at least one of a larger cross-sectional area and a deeper depth than voids defined in a heel portion of the midsole body.

2. The midsole of claim 1, wherein the voids are arranged in a two-dimensional area.

3. The midsole of claim 2, wherein the voids envelop at least 50% of a surface area of a top surface of the midsole body.

4. The midsole of claim 3, wherein the voids define at least one of a square, polygonal, and circular cross-sectional shape.

5. The midsole of claim 1, wherein voids defined in the metatarsus portion of the midsole body have at least one of a larger cross-sectional area and a deeper depth than voids defined in an arch portion.

6. A midsole for an article of footwear, the midsole comprising a midsole body defining voids of different depths, the voids arranged to provide relatively greater cushioning and bendability within at least one of a metatarsus portion and a calcaneus portion of the midsole body;

wherein voids defined in the metatarsus and calcaneus portions of the midsole body have at least one of a larger cross-sectional area and a deeper depth than any remaining voids defined by the midsole body.

7. The midsole of claim 6, wherein voids defined near a periphery of the midsole body have a shallower depth than any remaining voids defined by the midsole body.

8. The midsole of claim 7, wherein voids defined in a phalanges portion and an arch portion of the midsole body have a cross-sectional area of between about 4 $mm^2$ and about 25 $mm^2$.

9. The midsole of claim 6, wherein voids defined in the metatarsus and calcaneus portion of the midsole body have a depth of between about 4 mm and about 10 mm and voids defined in a phalanges portion and an arch portion of the midsole body have a depth of between about 1 mm and about 5 mm.

10. The midsole of claim 6, wherein voids defined in the metatarsus and calcaneus portions of the midsole body have a depth of between about 45% and 90% a thickness of the midsole body.

11. A midsole for an article of footwear, the midsole comprising a midsole body defining voids of different depths, the voids arranged to provide relatively greater cushioning and bendability within at least one of a metatarsus portion and a calcaneus portion of the midsole body;

wherein midsole body defines a two-dimensional array of voids each having a substantially square cross-sectional shaped in a top surface of the midsole body, the array having first and second perpendicular axes, both arranged to form an angle of about 45' with respect to a transverse axis of the midsole, voids defined in the metatarsus portion having a relatively deeper depth than voids defined by other portions of the midsole body.

12. An upper for an article of footwear, the upper comprising: a mesh enclosure having an inner layer connected to an outer layer by linking filaments, the outer layer defining apertures, apertures defined in a forefoot portion of the upper having a size relatively larger size than apertures defined in a heel portion of the upper; and a flex feature disposed on a medial portion of the upper and connecting a medial forefoot portion of the enclosure to a medial heel portion of the enclosure, the flex feature allowing the medial forefoot and medial heel portions of the enclosure to move relative to each other.

13. The upper of claim 12, wherein apertures defined by the outer enclosure layer in the forefoot portion of the upper have a diameter at least 25% larger than a diameter of apertures defined by the outer enclosure layer in the heel portion of the upper.

14. The upper of claim 12, wherein the apertures defined by the outer enclosure layer gradually transition in size between the forefoot and heel portions of the upper.

15. The upper of claim 12, wherein the apertures envelop at least 45% of the outer enclosure layer.

16. The upper of claim 12, wherein the mesh enclosure has a relatively tighter construction in the heel portion than the forefoot portion of the upper.

17. The upper of claim 16, wherein the construction of the mesh enclosure gradually transitions in tightness between the forefoot and heel portions of the upper.

18. The upper of claim 12, wherein the flex feature extends from a bottom sole edge of the upper to a lacing region of the upper.

19. The upper of claim 12, wherein a longitudinal axis of the flex feature is arranged at an angle of between about 30° and about 90° with respect to a ground contact surface of a sole attached to the upper.

20. The upper of claim 12, wherein the flex feature defines an arcuate shape.

21. The upper of claim 12, wherein the flex feature comprises a stretchable material.

22. The upper of claim 12, wherein the flex feature has a width in a direction along the surface of the enclosure of between about 2 mm and about 2 cm.

23. The upper of claim 12, wherein lateral and medial portions of the enclosure define corresponding lateral and medial clefts extending from a tongue opening defined by the enclosure and separating forward and heel portions of a lacing region of the upper, the clefts allowing the forward and heel portions of the lacing region of the upper to move with respect to each other.

24. The upper of claim 23, wherein the medial cleft extends from the tongue opening to a sole attached to the upper, separating the medial forefoot and medial heel portions of the enclosure, the flex feature connecting the separated medial forefoot and medial heel portions of the enclosure.

25. The upper of claim 24, wherein the flex feature terminates outside of the lacing region of the upper.

26. The upper of claim 12, further comprising a molded foam insert disposed about a foot opening defined by the enclosure, the molded foam insert defining embossed features arranged to anatomically fit a received foot.

27. A footwear article comprising: an upper assembly comprising: an enclosure defining a foot receiving void; and a flex feature disposed on a medial portion of the upper assembly and connecting a medial forefoot portion of the enclosure to a medial heel portion of the enclosure, the flex feature allowing the medial forefoot and medial heel portions of the enclosure to move relative to each other; and a sole assembly attached to the upper assembly, the sole assembly comprising: an outsole; and a midsole disposed on the outsole, the midsole defining voids of different depths, the voids arranged to provide relatively greater cushioning and bendability within at least one of a metatarsus portion and a calcaneus portion of the midsole.

28. The footwear article of claim 27, wherein the enclosure comprises a mesh having an inner layer connected to an outer layer by linking filaments, the outer layer defining apertures, wherein apertures defined in a forefoot portion of the upper assembly have a size relatively larger size than apertures defined in a heel portion of the upper assembly.

29. The footwear article of claim 28, wherein apertures defined by the outer enclosure layer in the forefoot portion of the upper have a diameter at least 25% larger than a diameter of apertures defined by the outer enclosure layer in the heel portion of the upper assembly.

30. The footwear article of claim 28, wherein the apertures defined by the outer enclosure layer gradually transition in size between the forefoot and heel portions of the upper assembly.

31. The footwear article of claim 28, wherein the apertures envelop at least 45% of the outer enclosure layer.

32. The footwear article of claim 27, wherein the enclosure comprises a mesh material has a relatively tighter construction in a heel portion of the upper assembly than a forefoot portion of the upper assembly.

33. The footwear article of claim 32, wherein the construction of the mesh enclosure gradually transitions in tightness between the forefoot and heel portions of the upper assembly.

34. The footwear article of claim 27, wherein the flex feature extends from the sole assembly to a lacing region of the upper assembly.

35. The footwear article of claim 27, wherein a longitudinal axis of the flex feature is arranged at an angle of between about 30° and about 90° with respect to a ground contact surface of the sole assembly.

36. The footwear article of claim 27, wherein the flex feature defines an arcuate shape.

37. The footwear article of claim 27, wherein the flex feature comprises a stretchable material.

38. The footwear article of claim 27, wherein the flex feature has a width in a direction along the surface of the enclosure of between about 2 mm and about 2 cm.

39. The footwear article of claim 27, wherein lateral and medial portions of the enclosure define corresponding lateral and medial clefts extending from a tongue opening defined by the enclosure and separating forward and heel portions of a lacing region of the upper, the clefts allowing the forward and heel portions of the lacing region of the upper to move with respect to each other.

40. The footwear article of claim 39, wherein the medial cleft extends from the tongue opening to the sole assembly, separating the medial forefoot and medial heel portions of the enclosure, the flex feature connecting the separated medial forefoot and medial heel portions of the enclosure.

41. The footwear article of claim 40, wherein the flex feature terminates outside of the lacing region of the upper.

42. The footwear article of claim 27, further comprising a molded foam insert disposed about a foot opening defined by the enclosure, the molded foam insert defining embossed features arranged to anatomically fit a received foot.

43. The footwear article of claim 27, wherein the voids are arranged in a two-dimensional area.

44. The footwear article of claim 27, wherein the voids envelop at least 50% of a surface area of a top surface of the midsole.

45. The footwear article of claim 27, wherein voids defined in the metatarsus portion of the midsole have at least one of a larger cross-sectional area and a deeper depth than voids defined in a heel portion of the midsole.

46. The footwear article of claim 27, wherein voids defined in the metatarsus portion of the midsole have at least one of a larger cross-sectional area and a deeper depth than voids defined in a phalanges portion of the midsole.

47. The footwear article of claim 27, wherein voids defined in the metatarsus portion of the midsole have at least one of a larger cross-sectional area and a deeper depth than voids defined in at least one of a phalanges portion, an arch portion, and the calcaneus portion of the midsole.

48. The footwear article of claim 27, wherein voids defined in the calcaneus portion of the midsole have at least one of a larger cross-sectional area and a deeper depth than voids defined in the metatarsus portion of the midsole.

49. The footwear article of claim 27, wherein voids defined in the metatarsus and calcaneus portions of the midsole have at least one of a larger cross-sectional area and a deeper depth than any remaining voids defined by the midsole.

50. The footwear article of claim 27, wherein voids defined near a periphery of the midsole have at least one of a smaller cross-sectional area and a shallower depth than any remaining voids defined by the midsole.

51. The footwear article of claim 27, wherein voids defined in the metatarsus and calcaneus portions of the midsole have a cross-sectional area of between about 4 $mm^2$ and about 100 $mm^2$; and voids defined in a phalanges portion and an arch portion of the midsole have a cross-sectional area of between about 4 $mm^2$ and about 25 $mm^2$.

52. The footwear article of claim 27, wherein voids defined in the metatarsus and calcaneus portion of the midsole have a depth of between about 4 mm and about 10 mm and voids defined in a phalanges portion and an arch portion of the midsole have a depth of between about 1 mm and about 5 mm.

53. The footwear article of claim 27, wherein voids defined in the metatarsus and calcaneus portions of the midsole have a depth of between about 45% and 90% a thickness of the midsole.

54. The footwear article of claim 27, wherein the midsole defines a two-dimensional array of voids each having a substantially square cross-sectional shape in a top surface of the midsole, the array having first and second perpendicular axes, both arranged to form an angle of about 45° with respect to a transverse axis of the midsole, voids defined in the metatarsus portion having a relatively deeper depth than voids defined by other portions of the midsole.

* * * * *